US008954219B2

(12) United States Patent
Kobayashi

(10) Patent No.: US 8,954,219 B2
(45) Date of Patent: Feb. 10, 2015

(54) INSTALLED IN VEHICLE FOR MONITORING TARGET SECTION IN THE VEHICLE

(75) Inventor: Masayuki Kobayashi, Anjo (JP)

(73) Assignee: Denso Corporation, Kariya (JP)

( * ) Notice: Subject to any disclaimer, the term of this patent is extended or adjusted under 35 U.S.C. 154(b) by 523 days.

(21) Appl. No.: 12/928,530

(22) Filed: Dec. 13, 2010

(65) Prior Publication Data

US 2011/0144852 A1 Jun. 16, 2011

(30) Foreign Application Priority Data

Dec. 14, 2009 (JP) ..... 2009-282985

(51) Int. Cl.
*G07C 5/08* (2006.01)

(52) U.S. Cl.
CPC ..... *G07C 5/0808* (2013.01)
USPC ..... 701/29.2

(58) Field of Classification Search
USPC ..... 701/29
See application file for complete search history.

(56) References Cited

U.S. PATENT DOCUMENTS 4,584,645 A * 4/1986 Kosak ..... 701/114
4,700,304 A * 10/1987 Byrne et al. ..... 701/76
2003/0060964 A1* 3/2003 Ozeki et al. ..... 701/114
2003/0144778 A1* 7/2003 Miyano ..... 701/29
2009/0254243 A1 10/2009 Uchihashi et al.

FOREIGN PATENT DOCUMENTS

| | | | |
|---|---|---|---|
| JP | 7-42609 | 2/1995 | |
| JP | 08-244611 | 9/1996 | |
| JP | 11-212784 | 8/1999 | |
| JP | 2001-195257 | 7/2001 | |
| JP | 2005-284847 | 10/2005 | |
| JP | 2005-319847 | 11/2005 | |
| JP | 2005319847 A * | 11/2005 | ..... B60R 16/02 |
| JP | 2006-236215 | 9/2006 | |
| WO | WO 2008/038741 | 4/2008 | |

OTHER PUBLICATIONS

Office Action issued Apr. 16, 2013 in corresponding Japanese Application No. 2009-282985 (with English translation).

* cited by examiner

*Primary Examiner* — Shelley Chen
(74) *Attorney, Agent, or Firm* — Harness, Dickey & Pierce, PLC

(57) ABSTRACT

In a device installed in a vehicle for monitoring a target section in the vehicle, an executing unit executes a specific process for addressing an abnormality in the target section, and an instructing unit instructs the executing unit to execute the specific process when an abnormality occurs in the target section. A determining unit determines when the specific process is required to be checked. A checking unit instructs the executing unit to execute the specific process independently of whether an abnormality occurs in the target section each time it is determined that the specific process is required to be checked, thus checking whether an abnormality occurs in the specific process.

16 Claims, 12 Drawing Sheets

INSTALLED IN VEHICLE FOR MONITORING TARGET SECTION IN THE VEHICLE

CROSS REFERENCE TO RELATED APPLICATIONS

This application is based on Japanese Patent Application 2009-282985 filed on Dec. 14, 2009. This application claims the benefit of priority from the Japanese Patent Application, so that the descriptions of which are all incorporated herein by reference.

TECHNICAL FIELD

The present disclosure relates to devices installed in a vehicle and adapted to monitor a predetermined target section in the vehicle.

BACKGROUND

Devices installed in a vehicle include devices for switching a process to be executed to another process according to the number of on/off operations of an ignition switch in the vehicle, an example of which is disclosed in Japanese Patent Application Publication No. H11-212784. These devices also include devices for checking a microcomputer's program memory in response to the turn-on of the ignition switch to check whether the microcomputer has an abnormality; this program memory represents a microcomputer's memory area in which programs are stored, an example of which is disclosed in Japanese Patent Application Publication No. H07-042609.

In addition, these devices include devices for executing processes, such as fail-safe processes, to address occurred abnormalities in the vehicle.

SUMMARY

The inventors have discovered that there is a point that should be improved in such devices for executing fail-safe processes to address occurred abnormalities in the vehicle.

Specifically, processes installed in a vehicle including a fail-safe process, which should be executed at the occurrence of corresponding abnormalities in the vehicle, aim at avoiding risks due to the occurred abnormalities. Thus, these processes are required to be always executable properly. In view of this aspect, it is important to check whether these processes are executable properly.

For example, a related art method for checking whether a fail-safe process installed in an article is executable properly is carried out in delivery inspection of the article, and therefore, no technologies have been disclosed to check whether a fail-safe process installed in an article is executable properly after delivery inspection of the article.

In view of the circumstances set forth above, one of various aspects of the present invention seeks to provide devices installed in a vehicle and designed to address the point that should be improved in such devices for executing fail-safe processes to address occurred abnormalities in a corresponding vehicle.

Specifically, an alternative of the various aspects of the present invention aims at providing devices installed in a vehicle and capable of checking whether a process that should be executed at the occurrence of a corresponding abnormality in the vehicle is executable properly after delivery inspection of the device.

According to one aspect of the present invention, there is provided a device installed in a vehicle for monitoring a target section in the vehicle. The device includes an executing unit configured to execute a specific process for addressing an abnormality in the target section, and an instructing unit configured to instruct the executing unit to execute the specific process when an abnormality occurs in the target section. The device includes a determining unit configured to determine when the specific process is required to be checked, and a checking unit configured to instruct the executing unit to execute the specific process independently of whether an abnormality occurs in the target section each time it is determined that the specific process is required to be checked, thus checking whether an abnormality occurs in the specific process.

Thus, the device installed in the vehicle can check the specific process at a proper timing determined by the determining unit. This can prevent the vehicle from being left with the abnormal specific process being unaddressed, resulting in a more improved safety of the vehicle.

According to another aspect of the present invention, there is provided a device installed in a vehicle for monitoring a target section in the vehicle. The device includes an executing unit configured to execute a specific process for addressing an abnormality in the target section, an instructing unit configured to instruct the executing unit to execute the specific process when an abnormality occurs in the target section, a trigger timing generating unit configured to automatically generate a trigger timing for checking whether an abnormality occurs in the specific process, and a checking unit configured to instruct the executing unit to execute the specific process in response to the trigger timing generated by the trigger timing generating unit.

Thus, the device installed in the vehicle can automatically carry out the check of the specific process in response to the trigger timing generated by the trigger timing generating unit. This can prevent the vehicle from being left with the abnormal specific process being unaddressed, resulting in a more improved safety of the vehicle.

The above and/or other features, and/or advantages of various aspects of the present invention will be further appreciated in view of the following description in conjunction with the accompanying drawings. Various aspects of the present invention can include and/or exclude different features, and/or advantages where applicable. In addition, various aspects of the present invention can combine one or more feature of other embodiments where applicable. The descriptions of features, and/or advantages of particular embodiments should not be constructed as limiting other embodiments or the claims.

BRIEF DESCRIPTION OF THE DRAWINGS

Various aspects of the invention will become apparent from the following description of embodiments with reference to the accompanying drawings in which.

Figure 1:
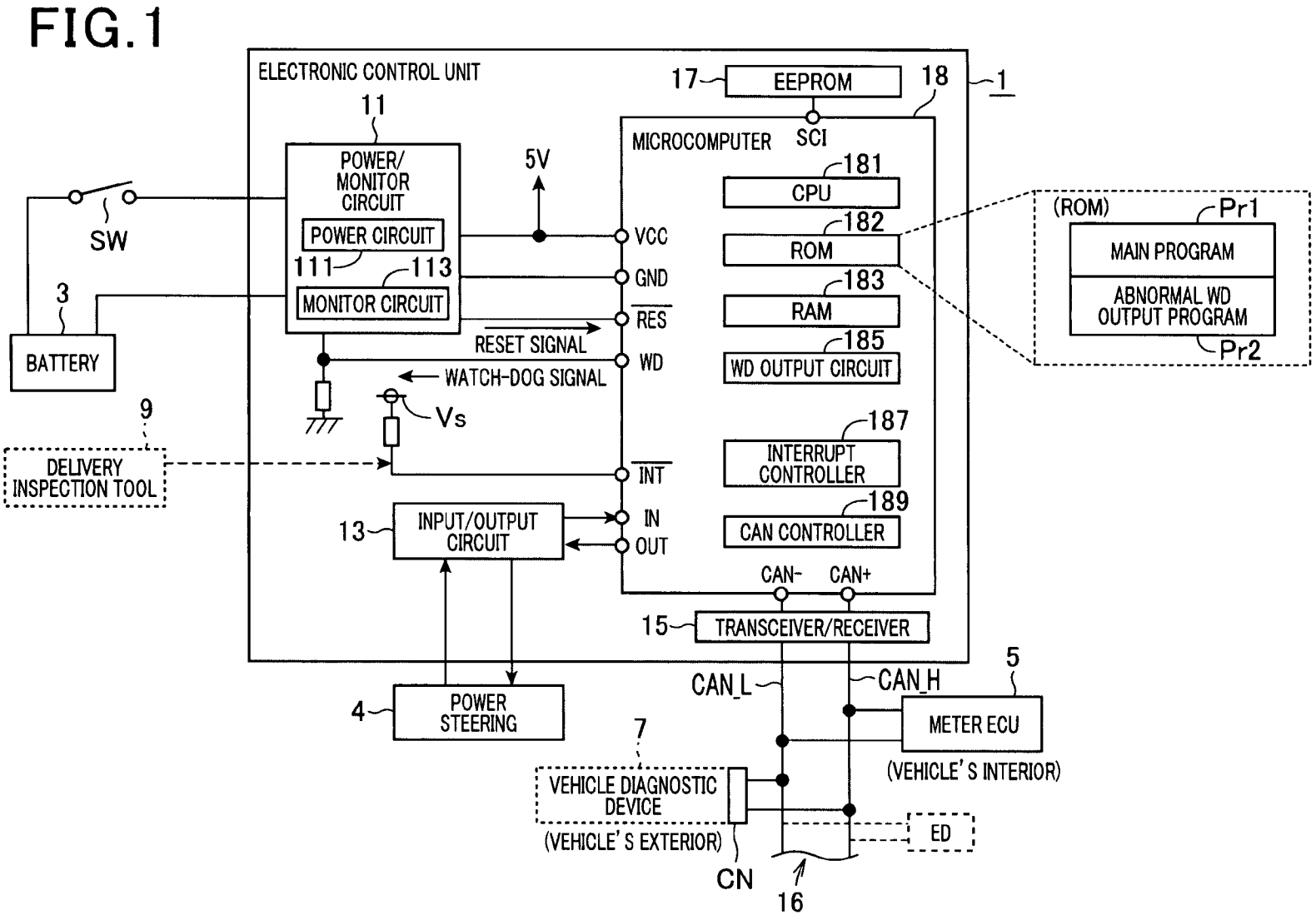
FIG. 1 is a block diagram schematically illustrating an example of the structure of an electronic control unit according to the first embodiment of one aspect of the present invention.
Figure 2:
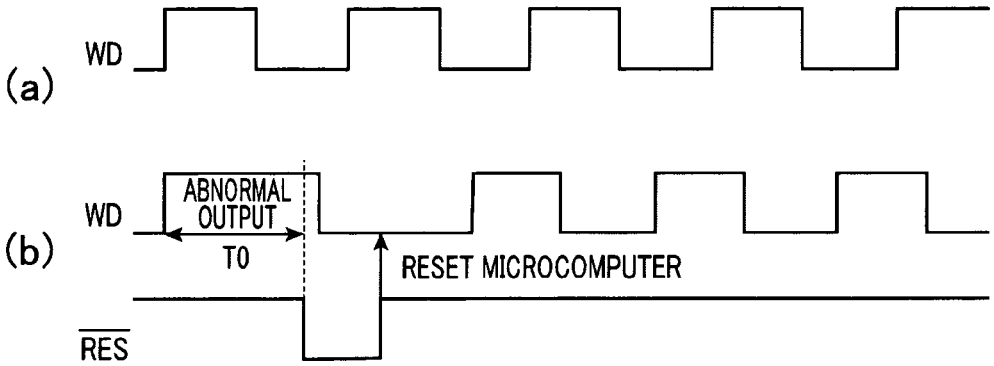
Figure 3:
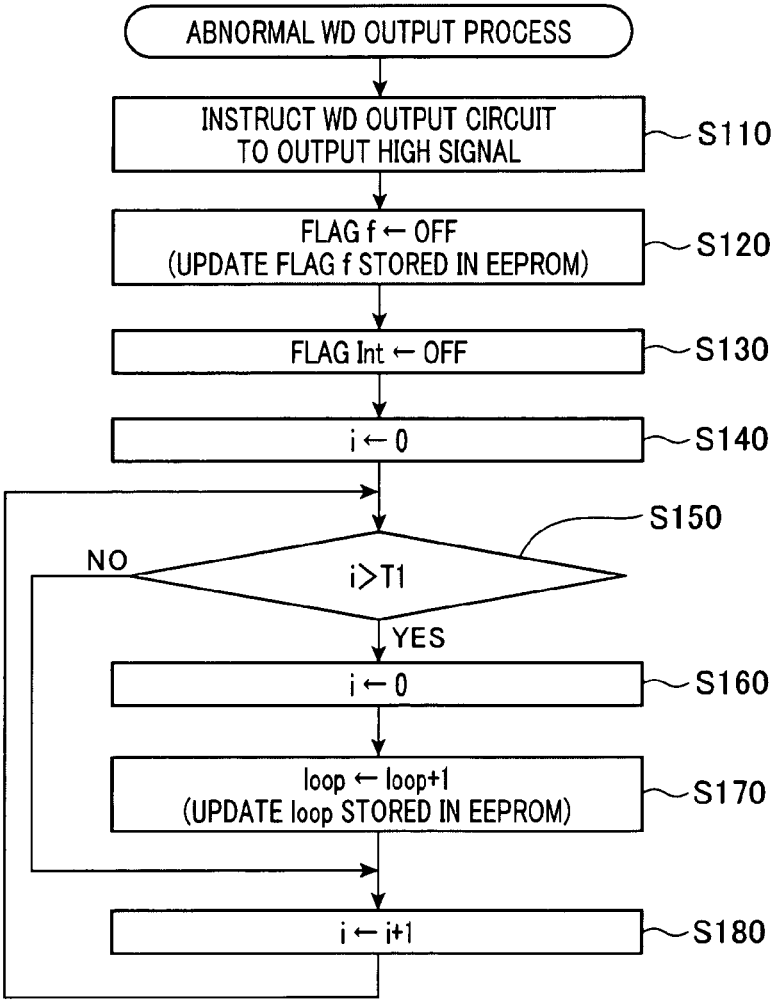
Figure 4:
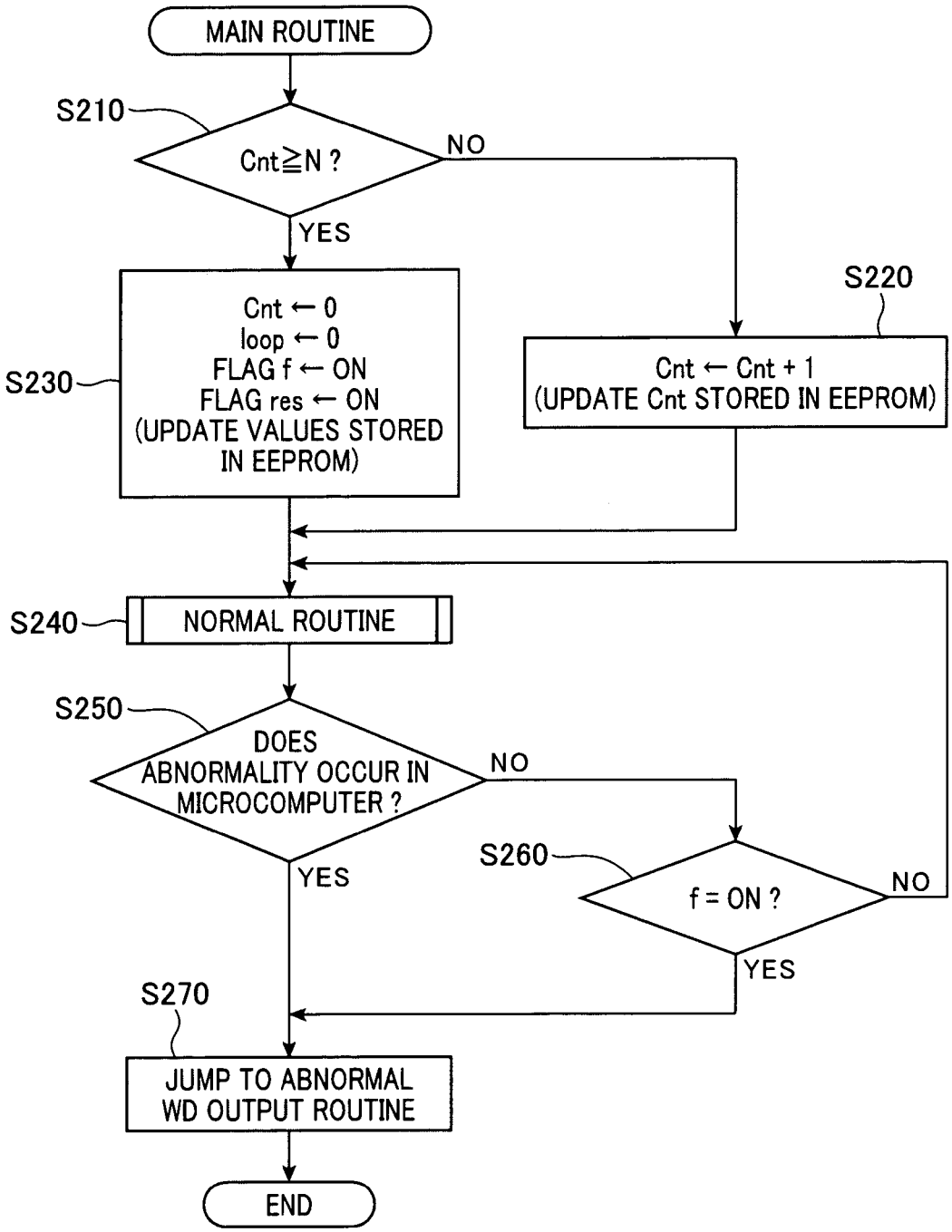
Figure 5:
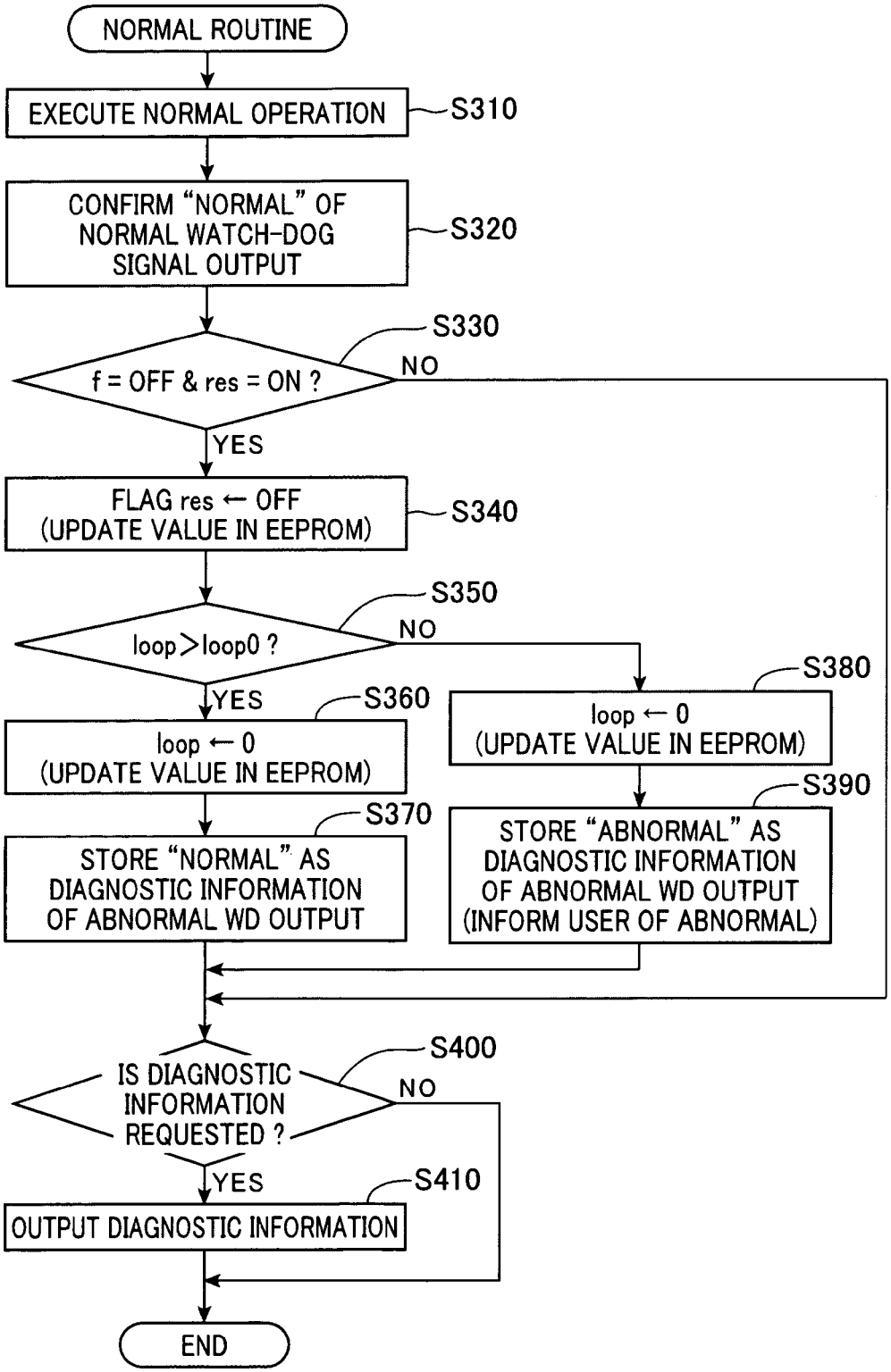
Figure 6:
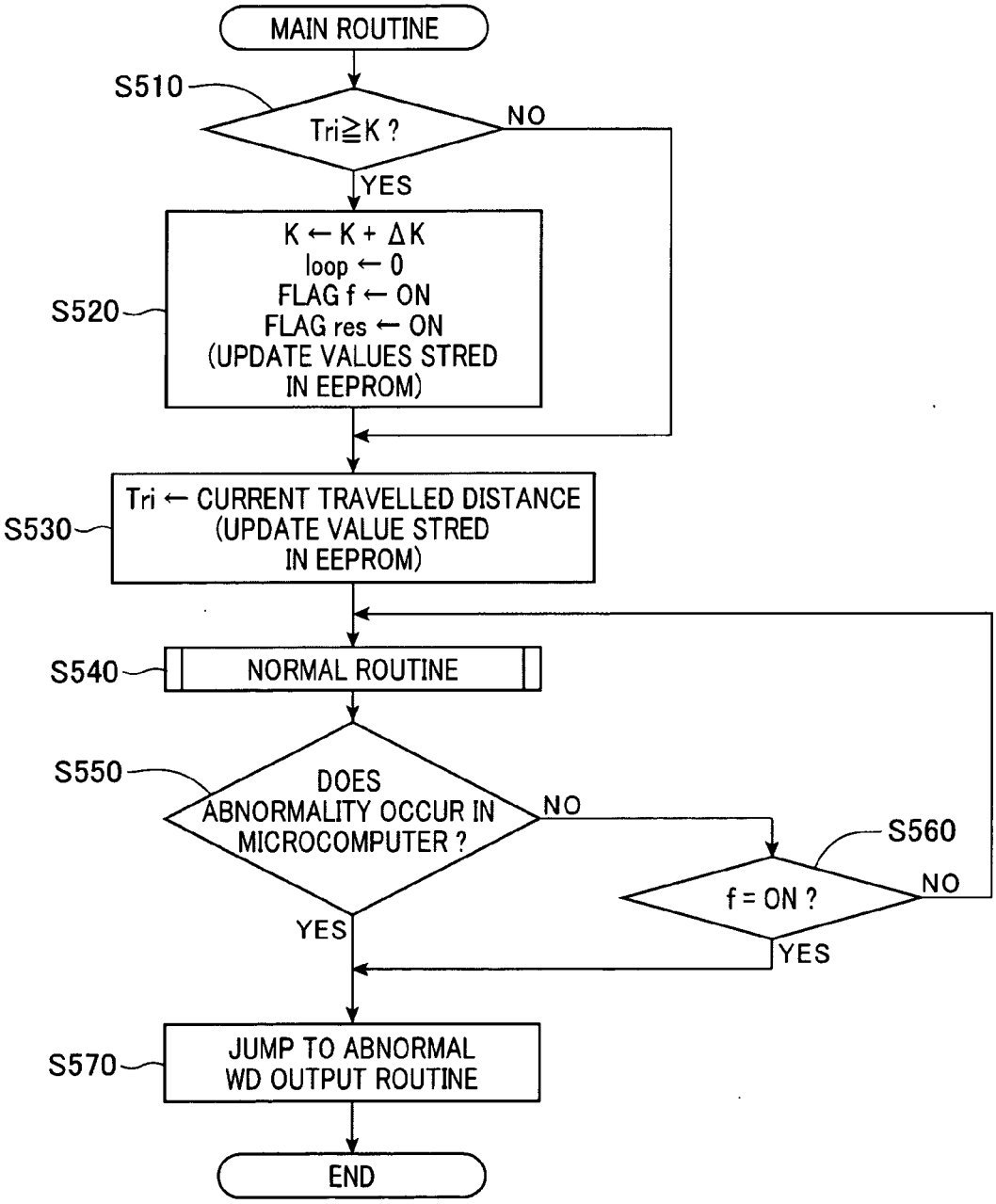
Figure 7:
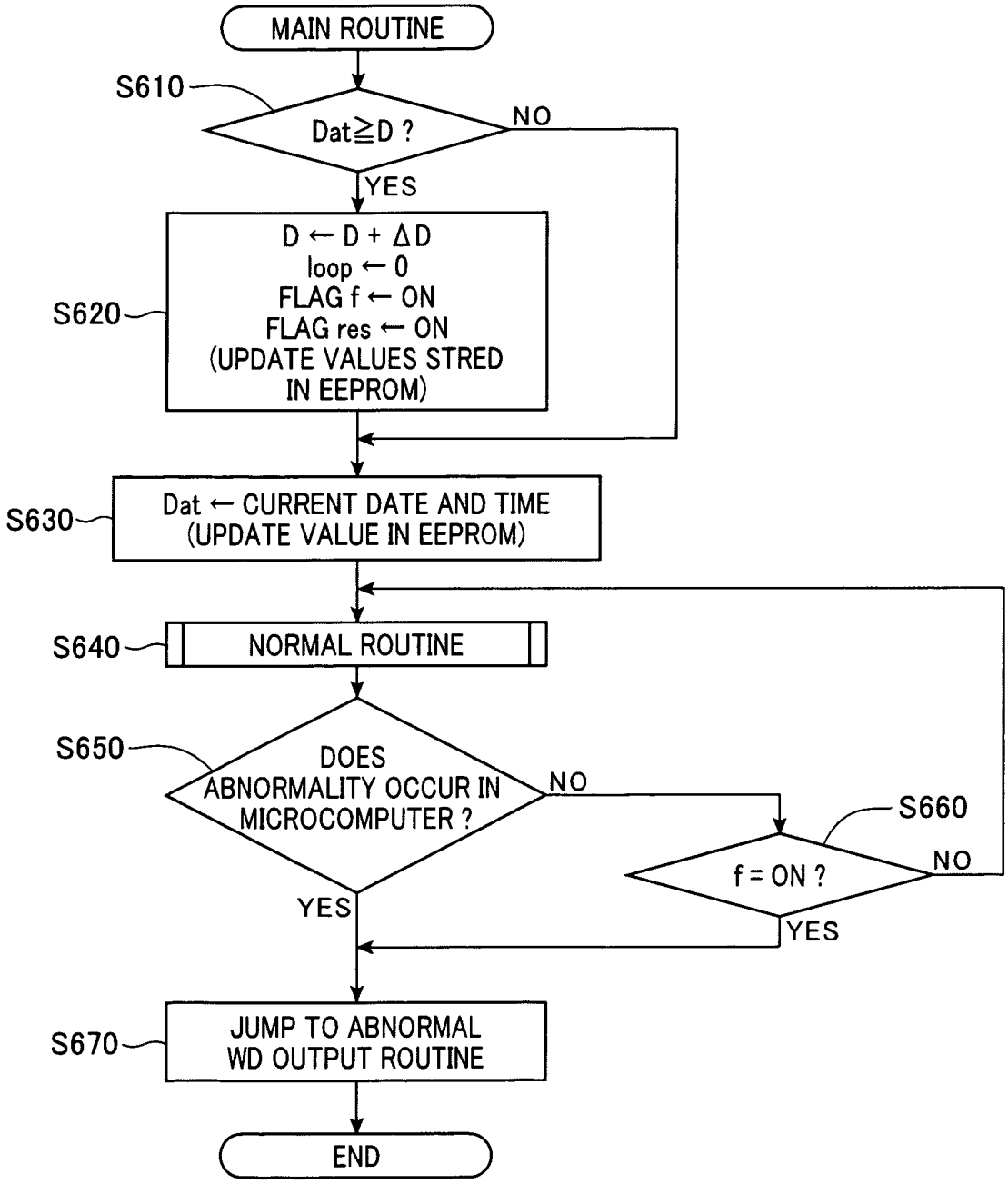
Figure 8:
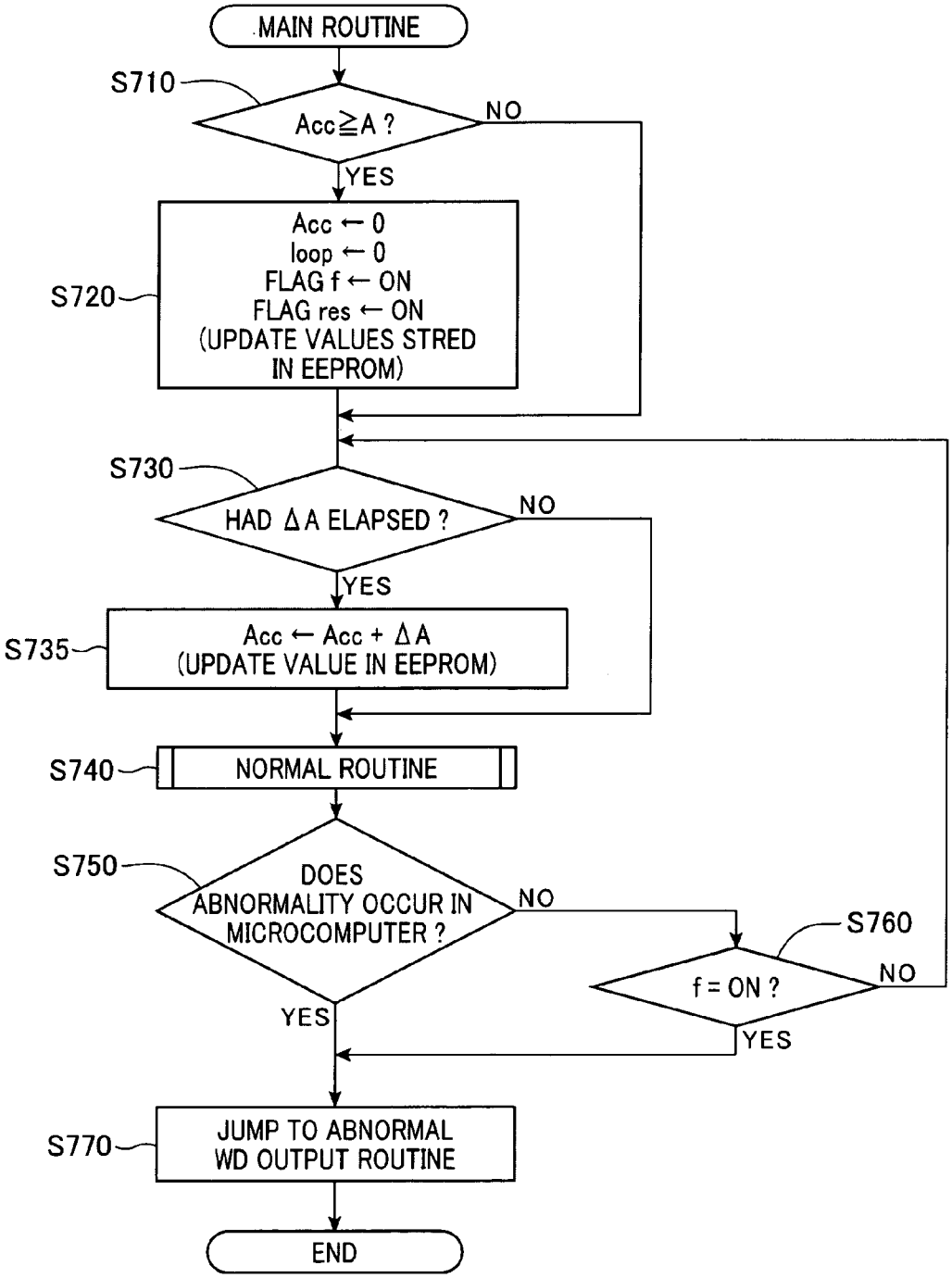
Figure 9:
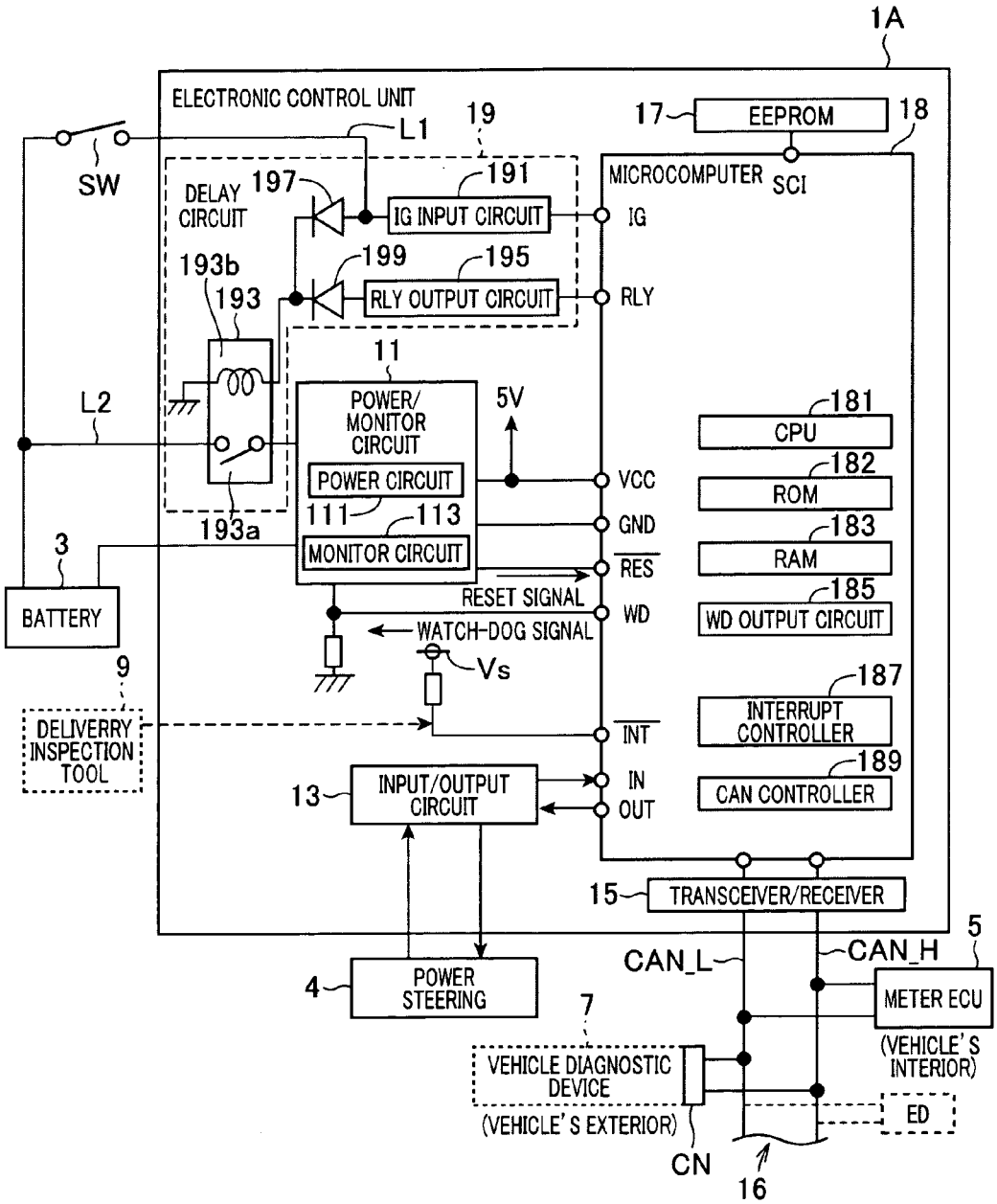
Figure 10:
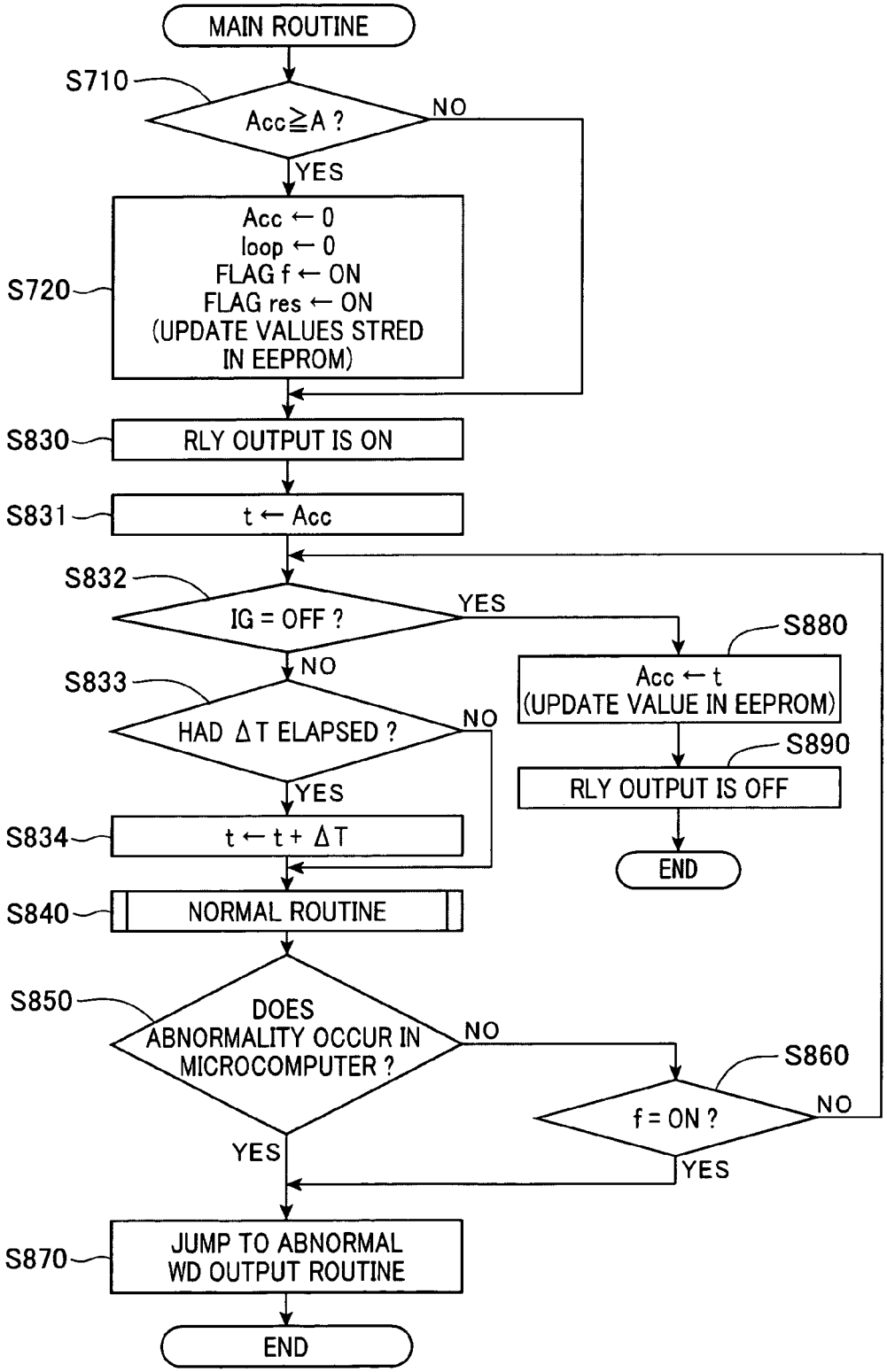
Figure 11:
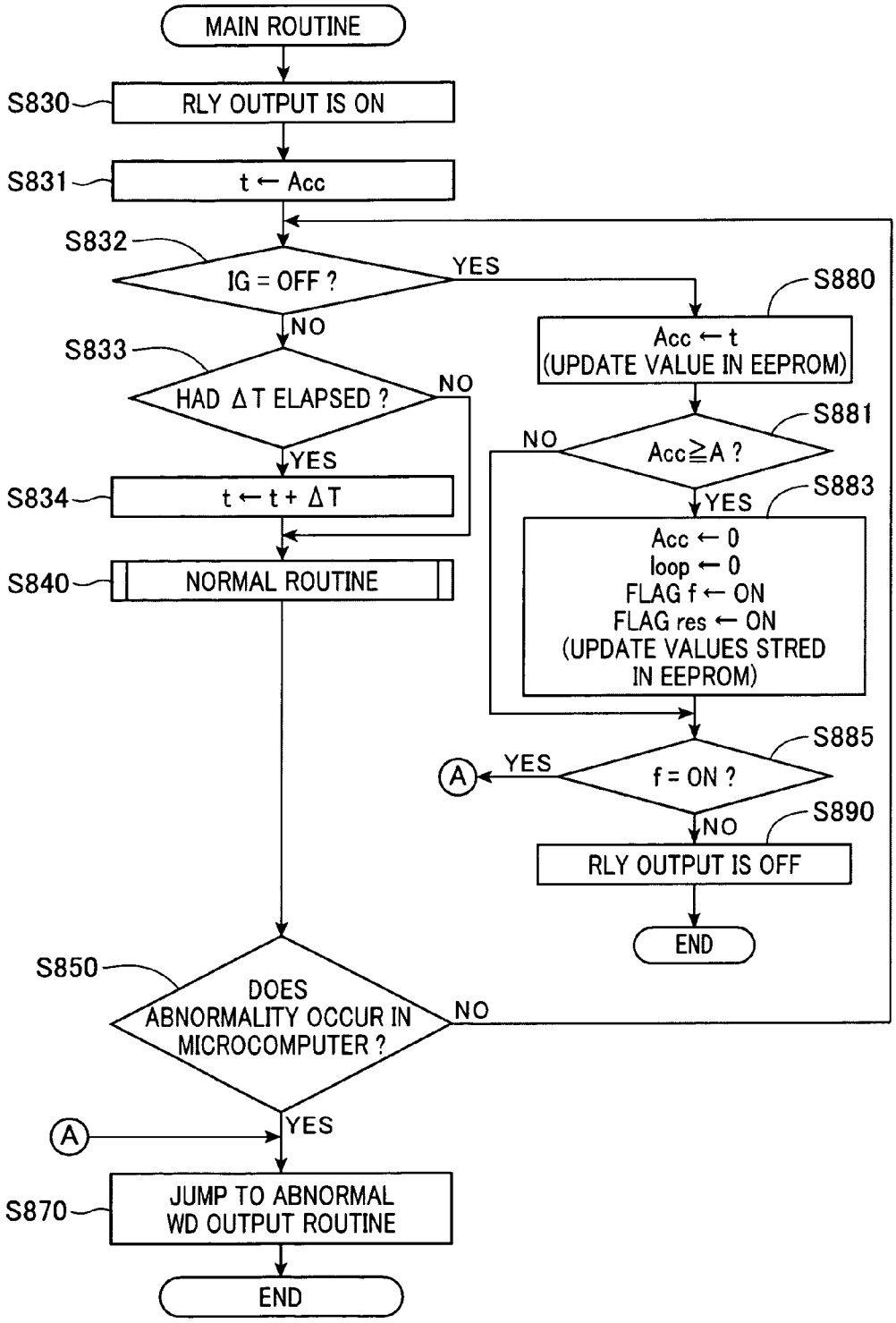
Figure 12:
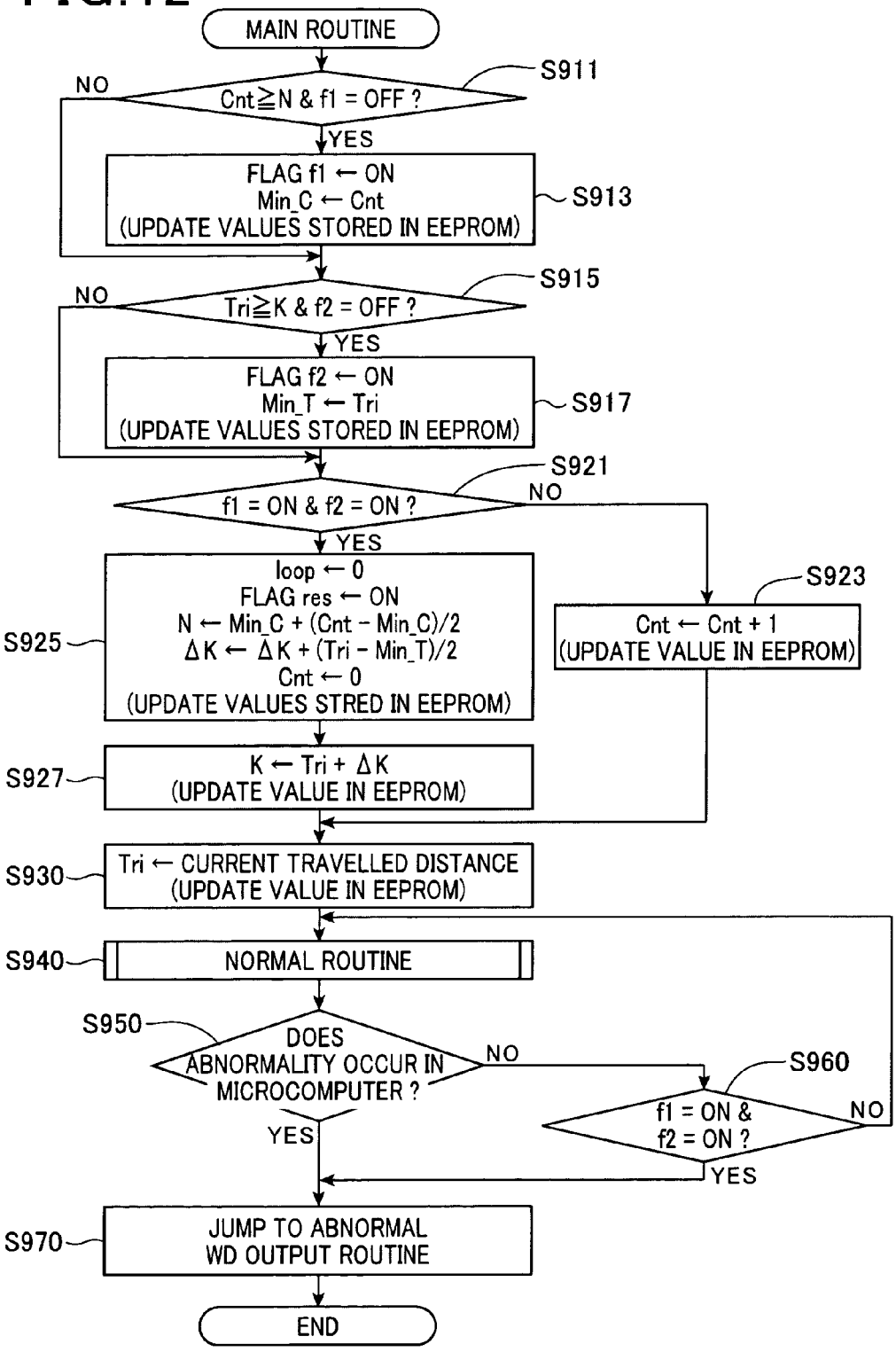
Figure 13:
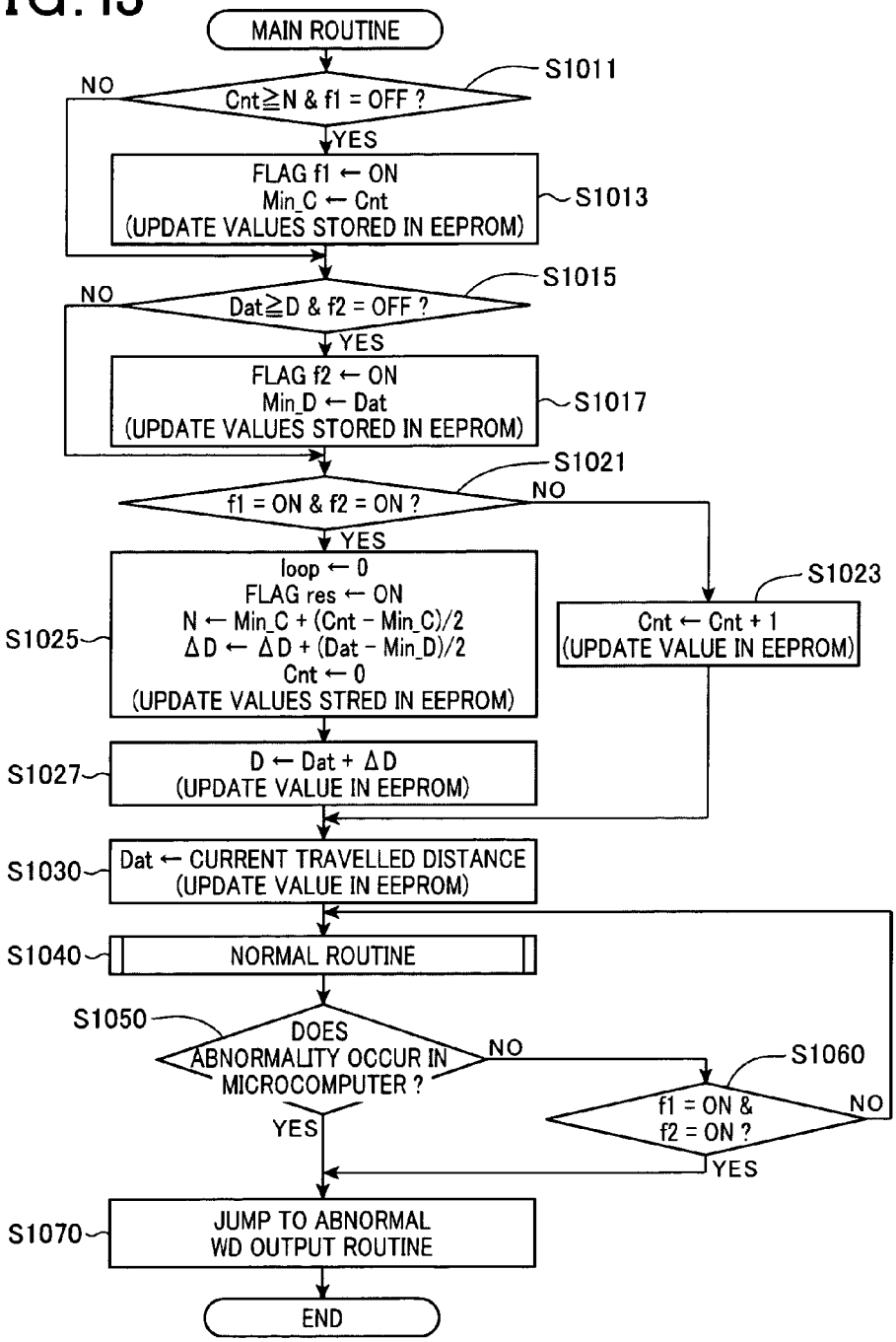
Figure 14:
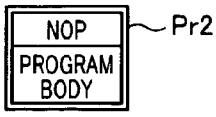

(a) of FIG. 2 is a timing chart schematically illustrating that a watch-dog signal is normal according to the first embodiment;

(b) of FIG. 2 is a timing chart schematically illustrating that a watch-dog signal is abnormal according to the first embodiment;

FIG. 3 is a flowchart schematically illustrating an abnormal WD output routine to be executed by a microcomputer illustrated in FIG. 1 according to the first embodiment;

FIG. 4 is a flowchart schematically illustrating a main routine to be executed by the microcomputer according to the first embodiment;

FIG. 5 is a flowchart schematically illustrating a normal routine to be executed by the microcomputer according to the first embodiment;

FIG. 6 is a flowchart schematically illustrating a main routine to be executed by the microcomputer according to the second embodiment of the present invention;

FIG. 7 is a flowchart schematically illustrating a main routine to be executed by the microcomputer according to the third embodiment of the present invention;

FIG. 8 is a flowchart schematically illustrating a main routine to be executed by the microcomputer according to the fourth embodiment of the present invention;

FIG. 9 is a block diagram schematically illustrating an example of the structure of an electronic control unit according to the fifth embodiment of one aspect of the present invention;

FIG. 10 is a flowchart schematically illustrating a main routine to be executed by the microcomputer according to the fifth embodiment of the present invention;

FIG. 11 is a flowchart schematically illustrating a main routine to be executed by the microcomputer according to the sixth embodiment of the present invention;

FIG. 12 is a flowchart schematically illustrating a main routine to be executed by the microcomputer according to the seventh embodiment of the present invention;

FIG. 13 is a flowchart schematically illustrating a main routine to be executed by the microcomputer according to the eighth embodiment of the present invention; and FIG. 14 is a view schematically illustrating a modification of the electronic control unit of each of the first to eighth embodiments.

DETAILED DESCRIPTION OF EMBODIMENTS OF THE INVENTION

Embodiments of the present invention will be described hereinafter with reference to the accompanying drawings. In the drawings, identical reference characters are utilized to identify identical corresponding components.

Referring to FIG. 1, there is illustrated an electronic control unit 1 installed in a vehicle, such as a four wheeled vehicle according to the first embodiment of the present invention. The electronic control unit 1 includes a power and monitor circuit 11, an input/output circuit 13, a transceiver/receiver 15, an EEPROM 17, and a microcomputer 18. The electronic control unit 1 is designed to carry out control of the vehicle.

The power and monitor circuit 11 incorporates a power circuit 111 and a monitor circuit 113, and is connected with a battery 3 via an ignition switch SW. The power circuit 111 is operative to convert an input voltage from the battery 3 into a 5-V voltage when the ignition switch SW is in on state, and supply the 5-V voltage to each element in the unit 1, such as the microcomputer 18 via a VCC terminal.

The monitor circuit 113 is operative to input a reset signal to the microcomputer 18. The power and monitor circuit 11 is connected with a WD (Watch Dog) terminal of the microcomputer 18; the microcomputer 18 continuously outputs a watch-dog signal via the WD terminal to the power and monitor circuit 11. The monitor circuit 113 is operative to input a high/low signal (a signal with a high level or low level) to an RES over-line terminal of the microcomputer 18 according to the watch-dog signal outputted from the microcomputer 18.

Specifically, as illustrated in FIG. 2A, the microcomputer 18 is operative to normally output, as the watch-dog signal, alternately a high signal with a high level for a constant period and a low signal with a low level for the same constant period via the WD terminal to the power and monitor circuit 11. The constant period of each of the high signal and the low signal is previously set to be shorter than a preset constant time T0.

(a) of FIG. 2 shows that the watch-dog signal is normal because the constant period is shorter than the preset constant time T0. While the normal watch-dog signal is inputted to the monitor circuit 113, the monitor circuit 113 continuously inputs the high signal as the reset signal to the microcomputer 18 via its reset terminal (RES). In contrast, (b) of FIG. 2 shows an example of an abnormal watch-dog signal because at least one high signal or at least one low signal is longer than the preset constant time T0.

When such an abnormal watch-dog signal is inputted to the monitor circuit 113, the monitor circuit 113 inputs the low signal as the reset signal to the microcomputer 18 via its reset terminal (RES). When the low signal as the reset signal is inputted from the monitor circuit 113 to the microcomputer 18, the microcomputer 18 resets itself. In other words, when the abnormal watch-dog signal is inputted to the monitor circuit 113, the monitor circuit 113 resets the microcomputer 18.

The input/output circuit 13 is connected with the microcomputer 18 via input and output terminals (IN and OUT), and with sensor devices and/or target devices to be controlled by the electronic control unit 1 and operative to input and output signals between these devices and the microcomputer 18. The input/output circuit 13 according to this embodiment is communicably connected with an electric power steering device 4, as a target device to be controlled by the electronic control unit 1, for generating torque (assist torque) to assist the driver's turning effort of a steering wheel of the vehicle.

Specifically, the electronic control unit 1 is operative to input control signals to the power steering device 4 via the input/output circuit 13 to thereby instruct the power steering device 4 to control the assist torque to be generated by the steering device 4 as control of the vehicle.

The transceiver/receiver 15 is connected with the microcomputer 18 and an in-vehicle LAN 16 and operative to establish communications between the microcomputer 18 and nodes connected with the in-vehicle LAN 16. For example, a meter ECU 5 for managing information of a travelled distance of the vehicle and the like is connected as a node with the in-vehicle LAN 16. That is, the transceiver/receiver 15 is communicable with the meter ECU 5 through the in-vehicle LAN 16. A connector CN is provided in the in-vehicle LAN 16. The connector CN allows the transmitter/receiver 15 to communicate with devices external to the vehicle via the in-vehicle LAN 16. A vehicle diagnostic device 7 for diagnosing the conditions of the vehicle can be for example connected with the connector CN.

An external output device EO for visibly or audibly outputting information externally of the vehicle is installed to be connected with the in-vehicle LAN 16. The external output device EO includes meters installed in, for example, an instrument panel of the vehicle in front of the driver's seat. The meters include various warning lights.

For example, as the in-vehicle LAN 16, a CAN bus consisting essentially of a pair of two signal lines (two-wire bus) CAN_H and CAN_L is used.

The CAN protocol to be used for communications through the CAN bus uses first and second different voltages. The first different voltage between the CAN_H and the CAN_L lines that is lower in voltage level than the CAN_H line represents a "dominant level" corresponding to a bit of logical 0 having a predetermined low voltage, such as 0 V, in digital data (binary data). The bit of logical 0 will be therefore referred to as "dominant bit" hereinafter. The second different voltage between the CAN_H and the CAN_L lines that is equal to or just higher in voltage level than the CAN_H represents a "recessive level" corresponding to a bit of logical 1 having a predetermined high voltage, such as 5 V, in digital data (binary data). The bit of logical 1 will be therefore referred to as "recessive bit" hereinafter. That is, through the CAN bus, CAN messages each consisting of a train of dominant bits (logical 0) and recessive bits (logical 1) are transferred.

The EEPROM 17 is a nonvolatile, electrically rewritable memory, and serves as a data storage area of the microcomputer 18. For example, in the EEPROM 17, data, which will be updated when the microcomputer 18 executes processes and should be stored after the ignition switch SW is off, is stored. The data to be stored in the EEPROM 17 will be described later.

The microcomputer 18 includes, for example, a CPU 181, a ROM 182, and a RAM 183 to be used as a working area when the CPU 181 executes various processes. The microcomputer 18 also includes, for example, a WD output circuit 185 for outputting the watch-dog signal to the power and monitor circuit 11, an interrupt controller 187, and a CAN (Controller Area Network) controller 189. The elements 181, 182, 183, 185, 187, and 189 are communicably connected with each other via buses (not shown).

The ROM 182 serves as a program storage area of the microcomputer 18, and stores therein programs to be run by the CPU 181. Specifically, in the ROM 182, at least a main program Pr1 for implementing main functions of the electronic control unit 1 and an abnormal WD output program Pr2 for outputting the abnormal watch-dog signal when an abnormality occurs in the vehicle are stored beforehand.

The WD output circuit 185 is operative to output the high signal as the watch-dog signal when the CPU 181 instructs the WD output circuit 185 to output the high signal, and output the low signal as the watch-dog signal when the CPU 181 instructs the WD output circuit 185 to output the low signal.

The CAN controller 189 is operative to communicate with the nodes connected to the in-vehicle LAN 16 in the CAN protocol via the transceiver/receiver 15 and CAN+ and CAN− terminals for the CAN_H and CAN_L lines set forth above. The interrupt controller 189 is operative to input an interrupt signal to the CPU 181 in response to when a falling edge from a high level to a low level appears in a signal inputted from an INT over-line terminal (INT terminal).

The ROM 182 stores therein a vector table VT in which an address correlated with the abnormal WD output program Pr2 is registered. For example, in the registered address in the ROM 18, the abnormal WD output program Pr2 is stored.

Specifically, when receiving the interrupt signal, the CPU 181 jumps its execution point to the registered address, and runs the abnormal WD output program Pr2 to thereby execute an abnormal WD output routine (see FIG. 3 described later) in accordance with the abnormal WD output program Pr2.

Note that, when the microcomputer 18 operates normally, a high signal with a preset high voltage level based on a power source Vs is continuously applied to the INT terminal. That is, the electronic control device 1 is designed such that no interrupt signals for instructing the microcomputer 18 to execute the abnormal WD output routine are generated as long as the microcomputer 18 operates normally.

The interrupt signal is generated when the INT terminal is grounded by a delivery inspection tool 9 so that the microcomputer 18 executes the abnormal WD output routine to thereby output the abnormal watch-dog signal. The delivery inspection tool 9 consists of, for example, a microcomputer, a monitor, an input unit, and a ground terminal.

Specifically, prior to shipping, in order to check whether a fail-safe process installed in the electronic control unit 1 is normally executable, an operator grounds the INT terminal using the ground terminal of the delivery inspection tool 9. If the fail-safe process is normally executable, the microcomputer 18 executes the abnormal WD output routine to thereby output the abnormal watch-dog signal from the WD output circuit 185 so that the outputted abnormal watch-dog signal causes the power and monitor circuit 11 to reset the microcomputer 18. That is, the operator checks whether the fail-safe process installed in the electronic unit 1 normally works by checking whether grounding the INT terminal resets the microcomputer 18. The series of processes from the execution of the abnormal WD output routine to the reset of the microcomputer 18 will be represented as the fail-safe process.

The delivery inspection tool 9 can be also connected with the connector CN so that the result of the execution of the WD output process by the check of the electronic control unit 1 prior to shipping can be supplied to the delivery inspection tool 9 via the in-vehicle LAN 16. The result of the execution of the WD output process can be, for example, displayed on the monitor of the delivery inspection tool 9 under control of the microcomputer. Thus, the operator can view the result of the execution of the WD output process to thereby determine whether the reset operation of the microcomputer 18 based on the execution of the WD output process is normally carried out.

Note that the check of whether the fail-safe process was normally executable based on the occurrence of the interrupt signal using the INT terminal is carried out in a specific work using the delivery inspection tool 9. For this reason, the checking work was basically carried out when the electronic control unit 1 is to be shipped. In view of such circumstances, the electronic control unit 1 according to the first embodiment is designed in consideration that operators, such as dealers, cannot carry out the check work based on the occurrence of the interrupt signal using the INT terminal except for some specific cases.

Specifically, in order to improve the flexibility in the timing to check whether the fail-safe process is normally executable in the electronic control unit 1, the electronic control unit 1 is equipped with a function to automatically check whether the fail-safe process is normally executable. Operations of the electronic control unit 1 to implement the function will be described later.

Next, the abnormal WD output routine to be executed by the CPU 181 in the abnormal WD output program Pr2 will be fully described hereinafter.

When launching the abnormal WD output program Pr2, the CPU 181 instructs the WD output circuit 185 to output the high signal in step S110.

For example, in a main routine based on the main program Pr1, a procedure to alternately switch between the high signal and the low signal as the watch-dog signal within the constant time T0 is incorporated beforehand. Thus, during the execution of the main routine, the CPU 181 alternately switches between the high signal and the low signal as the watch-dog signal such that the constant period of each of the high signal and the low signal is within the constant time T0 in order to output the normal watch-dog signal. Note that the abnormal WD output routine and the main routine are not carried out in parallel to each other.

The operation in step S110 instructs the WD output circuit 185 to continuously output the high signal during the execution of the abnormal WD output routine. Specifically, the operation in step S110 is to output the abnormal watch-dog signal to the power and monitor circuit 11 from the microcomputer 18, and to check whether an abnormality associated with the reset process (fail-safe process) of the microcomputer 18 occurs.

After the completion of the operation in step S110, the CPU 181 updates a flag f stored in the EEPROM 17 (see step S230 described later) to OFF (a value indicative of OFF) in step S120, and sets an interrupt flag Int to OFF in step S130. Note that the interrupt flag Int is provided beforehand in the interrupt controller 187 and, when a falling edge is inputted from the INT terminal, the interrupt controller 187 sets the interrupt flag Int to ON (a value indicative of ON). The operation in step S130 sets the interrupt flag Int to OFF in order to address the abnormal WD output routine by the occurrence of interrupts.

After the completion of the operation in step S130, the CPU 181 resets a prepared variable i to zero in step S140, and determines whether the variable i exceeds a preset constant value T1 in step S150. Upon determining that the variable i does not exceed the preset constant value T1 (NO in step S150), the CPU 181 increments the variable i by 1 in step S180, returning to step S150.

Otherwise, upon determining that the variable i exceeds the preset constant value T1 (YES in step S150), the CPU 181 resets the variable i to zero in step S160, and updates a variable loop stored in the EEPROM 17 to the sum of the variable loop and 1, in other words, increments the variable loop by 1 in step S170, proceeding to step S180.

That is, after proceeding to step S150 from step S140, the CPU 181 periodically increments the variable i by 1 in step S180, and increments the variable loop by 1 each time a constant time required for the variable i to reach the constant value T has elapsed.

Note that, because the abnormal WD output routine is designed as an infinite loop, the abnormal WD output routine is continuously carried out until the microcomputer 18 is reset. The value of the variable loop corresponding to a time taken from the start of the abnormal WD output routine to the reset of the microcomputer 18 is stored in the EEPROM 17 with the value of the variable loop being nonvolatile after the reset of the microcomputer 18. Note that, in contrast, because the value of the variable i is stored in the RAM 183, it can be made volatile.

Next, the main routine to be executed by the CPU 181 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 4 as "SWITCHING OPERATION S".

When launching the main program Pr1, the CPU 181 reads a value of a prepared variable Cnt and a criteria value N stored in the EEPROM 17 in step S210; this variable Cnt represents the number of starts of the vehicle, which will be referred to as the number Cnt of starts of the vehicle. The number of starts of the vehicle is an example of a parameter indicative of the amount of operation of the electronic control unit 1. The number of on-operations of the ignition switch SW or the number of on-operations of an accessory switch (not shown) can be used as the parameter indicative of the amount of operation of the electronic control unit 1.

Then, in step S210, the CPU 181 determines when the fail-safe process is required to be checked by determining whether the number Cnt of starts of the vehicle is equal to or higher than the criteria value N. Note that the criteria value N is used to determine when the fail-safe process is required to be checked, and determined beforehand in the design stage of the electronic control unit 1.

Upon determining that the number Cnt of starts of the vehicle is lower than the criteria value N, the CPU 181 determines that the fail-safe process is not required to be checked (NO in step S210). Then, the CPU 181 updates the number Cnt of starts of the vehicle stored in the EEPROM 17 so that the number Cnt of starts of the vehicle is incremented by 1 in step S220, proceeding to step S240. Otherwise, upon determining that the number Cnt of starts of the vehicle is equal to or higher than the criteria value N, the CPU 181 determines that the fail-safe process is required to be checked (YES in step S210). Then, the CPU 181 resets, to zero, each of the number Cnt of starts of the vehicle and the variable loop, and updates each of the flag f and a flag res stored in the EEPROM 17 to ON in step S230, proceeding to step S240. For example, an initial value of each of the flags f and res is set to OFF.

In step S240, the CPU 181 executes a normal routine illustrated in FIG. 5, and, after the completion of the normal routine, determines whether an abnormality occurs in the microcomputer 18 based on a result of the execution of the normal routine in step S250. For example, in step S250, the CPU 181 determines whether an abnormality occurs in the microcomputer 18 by determining whether a result of the execution of the operation in step S310 described later is normal.

Upon determining that an abnormality occurs in the microcomputer 18 (YES in step S250), the CPU 181 jumps to the address in which the abnormal WD output program Pr2 is stored, exits the main routine, and executes the abnormal WD output routine in accordance with the abnormal WD output program Pr2 illustrated in FIG. 3.

Otherwise, upon determining that an abnormality does not occur in the microcomputer 18 (NO in step S250), the CPU 181 reads the flag f stored in the EEPROM 17, and determines whether the flag f is set to ON in step S260.

That is, the operation in step S260 represents execution of the abnormal WD output routine although no abnormalities occur in the microcomputer 18 when it is determined that the fail-safe process is required to be checked (the flag f is set to ON) (YES in step S210).

Specifically, upon determining that the flag f is set to ON (YES in step S260), the CPU 181 proceeds to step S270, and jumps to the address in which the abnormal WD output program Pr2 is stored, exits the main routine, and executes the abnormal WD output routine in accordance with the abnormal WD output program Pr2 illustrated in FIG. 3. That is, the abnormal WD output routine is carried out for checking the fail-safe process.

On the other hand, upon determining that the flag f is set to OFF (NO in step S260), the CPU 181 proceeds to step S240, and repeatedly executes the normal routine illustrated in FIG. 5 until an abnormality occurs in the microcomputer 18 or the flag f is set to ON. Note that the operation to set the flag f to ON has been carried out only once in step S230 when the microcomputer 18 is booted up. Thus, if the operation in step S230 is not carried out during the start up of the microcomputer 18, the flag f is unset to ON until the restart of the microcomputer 18. These operations in the main routine according to the first embodiment prevent the abnormal WD output routine from being carried out for the purpose of checking the fail-safe process during the vehicle travelling.

Next, the normal routine in step S240 will be fully described hereinafter.

When starting the normal routine in step S240, the CPU 181 executes normal operations associated with main functions of the electronic control unit 1 in step S310. After the completion of the operations in step S310, the CPU 181 determines that the operation of outputting the normal watch-dog signal is normally carried out, thus storing, in the EEPROM 17, diagnostic information representing that the operation of outputting the normal watch-dog signal by the microcomputer 18 is normally carried out in step S320.

The reason why it is determined that the operation of outputting the normal watch-dog signal is normally carried out in step S320 is that the time required to perform the operations in step S310 is sufficiently longer than the constant time T0 for determining whether the watch-dog signal is abnormally outputted. Specifically, if the watch-dog signal is abnormally outputted, the microcomputer 18 is reset before execution of the operation in step S320 so that the operation in step S320 cannot be carried out. For this reason, the CPU 181 determines that the operation of outputting the normal watch-dog signal is normally carried out.

Following the completion of the operation in step S320, the CPU 181 proceeds to step S330, reads the flags f and res from the EEPROM 17, and determines whether the flag f is set to OFF and the flag res is set to ON in step S330.

This operation in step S330 determines whether the current normal routine is carried out at the first time after the reset of the microcomputer 18 based on the execution of the abnormal WD output routine when it is determined that the fail-safe process is required to be checked.

Specifically, if the abnormal WD output routine is carried out in response to when the fail-safe task is required to be checked so that the microcomputer 18 is reset, during execution of the normal routine at the first time after the reset of the microcomputer 18, the flag f is set to OFF and the flag res is set to ON. At that time, the CPU 181 determines to carry out check of the fail-safe process. Then, the CPU 181 carries out an affirmative determination in step S330, proceeding to step S340. Except for the condition that the flag f is set to OFF and the flag res is set to ON, the CPU 181 determines not to carry out check of the fail-safe process. Then, the CPU 181 carries out a negative determination in step S330, proceeding to step S400.

In step S340, the CPU 181 updates the flag res stored in the EEPROM 17 to OFF, proceeding to step S350. In step S350, the CPU 181 determines whether the variable loop stored in the EEPROM 17 exceeds a preset criteria value loop0. Note that the criteria value loop0 is determined beforehand in the design stage of the electronic control unit 1 in consideration of a time required for the monitor circuit 113 to detect the abnormal output of the watch-dog signal, and to reset the microcomputer 18 in response to a result of the detection.

Upon determining that the variable loop stored in the EEPROM 17 exceeds the preset criteria value loop0 (YES in step S350), the CPU 181 resets the variable loop stored in the EEPROM 17 to zero in step S360. Then, the CPU 181 determines that no abnormalities occur in the fail-safe process, thus storing, in the EEPROM 17, diagnostic information representing that the operation of outputting the abnormal watch-dog signal by the microcomputer 18 is normally carried out in step S370. Thereafter, the CPU 181 proceeds to step S400.

Otherwise, upon determining that the variable loop stored in the EEPROM 17 does not exceed the preset criteria value loop0 (NO in step S350), the CPU 181 resets the criteria value loop0 to zero in step S380. Then, the CPU 181 determines that an abnormality occurs in the fail-safe process, thus storing, in the EEPROM 17, diagnostic information representing that the operation of outputting the abnormal watch-dog signal by the microcomputer 18 is abnormally carried out in step S390. Thereafter, the CPU 181 proceeds to step S400.

Note that, in step S390, the CPU 181 can visibly and/or audibly inform a user, such as the driver, of the occurrence of an abnormality via the external output device EO. For example, the CPU 181 can turn on at least one of the warning lights.

The reason why the fail-safe process is determined to be abnormal when the variable loop is equal to or lower than the criteria value loop0 is as follows.

Specifically, if the time taken from the start of the abnormal WD output routine to the reset of the microcomputer 18, which is represented by the variable loop, were shorter than a corresponding time taken from the start of the abnormal WD output routine to the reset of the microcomputer 18, which is predicted when the abnormal watch-dog signal is normally outputted as the criteria value loop0, the fail-safe process might be carried out although when it does not need to be carried out so that the microcomputer 18 might be reset. This might cause vehicle safety hazards.

However, when the variable loop is higher than the criteria value loop0, the fail-safe process can be considered to be normally carried out because there is no possibility of the occurrence of these vehicle safety hazards.

Although the abnormal WD output routine is carried out in response to when the fail-safe task is required to be checked, if the microcomputer 18 were not reset, the normal routine after the reset of the microcomputer 18 would not be carried out. Thus, the electronic control unit 1 according to the first embodiment is designed in no consideration of an abnormality, which causes disabling of the reset of the microcomputer 18. However, if the reset of the microcomputer 18 were disabled, the main routine would not be carried out because the microcomputer 18 would not be reset. In addition, the fail-safe process checking operations are programmed to be carried out during the start up of the microcomputer 18, that is, they are programmed to be carried out with little influence on the vehicle safety. Thus, no consideration of such an abnormality has little impact on the vehicle safety.

As described above, when it is determined that the flag f is set to ON (YES in step S260), before executing the abnormal WD output routine illustrated in FIG. 3 for the purpose of the check of the fail-safe process, the CPU 181 can visibly and/or audibly inform, via the informing means, a user, such as the driver, of a message indicative of the start of check of the fail-safe process. In addition, after the check of the fail-safe process, in step S370 or S390, the CPU 181 can visibly and/or audibly inform, via the informing means, a user, such as the driver, of the result of the check, which is identical to the corresponding diagnostic information to be stored in the EEPROM 17. This modification can inform a user, such as the driver, of the occurrence of an abnormality in the fail-safe process.

Following the operation in step S370 or S390, the CPU 181 determines whether to receive a request signal from a device external, such as the vehicle diagnostic device 7, to the vehicle via the in-vehicle LAN 16 in step S400; this request signal requests the CPU 181 to send diagnostic information. Upon determining to receive the request signal (YES in step S400), the CPU 181 proceeds to step S410. In step S410, the CPU 181 reads diagnostic information corresponding to the request signal from the EEPROM 17, and sends, to the source of the request signal, such as the external device, the read-out diagnostic information. Specifically, when the request signal requests the CPU 181 to send diagnostic information associated with the abnormal output of the watch-dog signal, the CPU 181 sends, to the source of the request signal, the diagnostic information stored in step S370 or S390. Thereafter, the CPU 181 exits the normal routine once.

In the first embodiment, a specific process for addressing an abnormality occurs in a target section corresponds to, for example, the abnormal WD output routine. An instructing unit configured to instruct an executing unit to execute the specific process when an abnormality occurs in the target section can be implemented by, for example, the operation in step S250. A determining unit configured to determine when the specific process is required to be checked can be implemented by, for example, the operations in steps S210 and S260. A checking unit configured to instruct the executing unit to execute the specific process independently of whether an abnormality occurs in the target section each time it is determined that the specific process is required to be checked, thus checking whether an abnormality occurs in the specific process can be implemented by, for example, the operations in step S260 and steps S330 to S390.

An obtaining unit configured to obtain information indicative of an amount of operation of the device can be implemented by, for example, the operation in step S210 to obtain the number Cnt of starts of the vehicle from the EEPROM 17. An external output unit configured to output information indicative of a result of the check of the specific process externally of the vehicle can be implemented by, for example, the operation in step S410 and the external output device EO.

As described above, the electronic control unit 1 according to the first embodiment is configured to carry out the check of the fail-safe process at a given timing according to the number Cnt of starts of the vehicle. This makes it possible to prevent vehicles each having the fail-safe process that cannot be normally carried out from being left with the abnormal fail-safe process being unaddressed. This results in a more improved safety of each of vehicles in which the electronic control unit 1 is installed.

Note that the criteria value N can be preferably determined in the design stage of the electronic control unit 1 in accordance with the concept of the function-safety standard as IEC 61508 standard such that the executing interval of the check of the fail-safe process does not exceed the half (T/2) of an average operating time T of the electronic control unit 1 until an abnormality, such as a random fault, occurs therein. However, because high frequency of execution of the check of the fail-safe process may cause users to have a compliant with the high frequency of execution of the check of the fail-safe process, excessive reduction of the executing interval of the check of the fail-safe process is undesirable for the users. Thus, the criteria value N can be preferably determined properly according to the relationship between a predicted number of starts of the vehicle and a predicted operating time of the electronic control unit 1 in a predicted utility form of the vehicle.

In addition, because the operating time of the electronic control unit 1 per start of the vehicle is different for each user, adjustment of the criteria value N to adjust the executing interval of the check of the fail-safe process has limitations. Thus, the electronic unit 1 installed in each of various vehicles can be designed to determine when the fail-sage process is required to be checked according to the travelled distance of a corresponding one of the various vehicles.

Second Embodiment

An electronic control unit 1 according to the second embodiment of the present invention will be described hereinafter with reference to FIG. 6.

The structure and/or functions of the electronic control unit 1 according to the second embodiment are substantially identical to those of the electronic control unit 1 according to the first embodiment except for a main routine described later. So, the different point will be mainly described hereinafter.

The electronic control unit 1 according to the second embodiment is designed to adjust the check interval according to the travelled distance of the vehicle.

The main routine to be executed by the CPU 181 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 6 as "SWITCHING OPERATION S".

When launching the main program Pr1, the CPU 181 reads a value of a prepared variable Tri and a criteria value K stored in the EEPROM 17 in step S510; this variable Tri represents the travelled distance of the vehicle, which will be referred to as the travelled distance Tri. Then, in step S510, the CPU 181 determines when the fail-safe process is required to be checked by determining whether the travelled distance Tri is equal to or higher than the criteria value K. The travelled distance of the vehicle is an example of the parameter indicative of the amount of operation of the electronic control unit 1.

Note that, prior to shipping, the travelled distance Tri stored in the EEPROM 17 is set to zero, and the criteria value K is set to ΔK. In this embodiment, the CPU 181 is programmed to determine that the fail-safe process is required to be checked each time the travelled distance Tri increases by a preset distance, and the value ΔK corresponds to the preset distance. In accordance with the same inventive concept as that of the first embodiment, the value ΔK can be determined in the design stage of the electronic control device 1 according to the second embodiment such that the executing interval of the check of the fail-safe process does not exceed the half (T/2) of the average operating time T of the electronic control unit 1 until an abnormality, such as a random fault, occurs therein.

Upon determining that the travelled distance Tri is lower than the criteria value K, the CPU 181 determines that the fail-safe process is not required to be checked (NO in step S510), proceeding to step S530. Otherwise, upon determining that the travelled distance Tri is equal to or higher than the criteria value K, the CPU 181 determines that the fail-safe process is required to be checked (YES in step S510). Then, the CPU 181 updates the criteria value K to the sum of the criteria value K and the value ΔK, and resets the variable loop to zero, and updates each of the flag f and the flag res stored in the EEPROM 17 to ON in step S520, proceeding to step S530.

In step S530, the CPU 181 communicates with the meter ECU 5 via the CAN controller 189 and the transceiver/receiver 15 to thereby obtain, from the meter ECU 5, a current travelled distance (accumulated distance) M_Tri of the vehicle, and updates a value of the travelled distance Tri to the obtained value M_Tri from the EEPROM 17. Thereafter, the CPU 181 executes the operations in steps S540 to S570 identical to the operations in steps S240 to S270, respectively.

Specifically, upon determining that an abnormality occurs in the microcomputer 18 (YES in step S550) or that the flag f is set to ON (YES in step S560), the CPU 181 jumps to the address in which the abnormal WD output program Pr2 is stored, exits the main routine, and executes the abnormal WD output routine in accordance with the abnormal WD output program Pr2 illustrated in FIG. 3. That is, the abnormal WD output routine is carried out for checking the fail-safe process.

Otherwise, upon determining that no abnormalities occur in the microcomputer 18 (NO in step S550) and that the flag f is set to OFF (NO in step S560), the CPU 181 repeatedly executes the normal routine illustrated in FIG. 5.

In the second embodiment, an instructing unit configured to instruct an executing unit to execute the specific process when an abnormality occurs in the target section can be implemented by, for example, the operation in step S550. A determining unit configured to determine when the specific process is required to be checked can be implemented by, for example, the operations in steps S510 and S560. A checking unit configured to instruct the executing unit to execute the specific process independently of whether an abnormality occurs in the target section each time it is determined that the specific process is required to be checked, thus checking whether an abnormality occurs in the specific process can be implemented by, for example, the operations in step S560 and steps S330 to S390. An obtaining unit configured to obtain information indicative of an amount of operation of the device can be implemented by, for example, the operation in step S530.

As described above, the electronic control unit 1 according to the second embodiment is configured to carry out the check of the fail-safe process at a given timing according to the travelled distance Tri in place of the number Cnt of starts of the vehicle. Thus, in addition to the technical effects achieved by the electronic control unit 1 according to the first embodiment, it is possible to automatically carry out the check of the fail-safe process at intervals that are determined properly depending on variations of user's utility form of the vehicle.

Specifically, in the second embodiment, the value ΔK can be determined so that the check interval does not exceed the half (T/2) of the average operating time T of the electronic control unit 1 until an abnormality, such as a random fault, occurs therein, and is not excessively reduced.

Third Embodiment

An electronic control unit 1 according to the third embodiment of the present invention will be described hereinafter with reference to FIG. 7.

The structure and/or functions of the electronic control unit 1 according to the third embodiment are substantially identical to those of the electronic control unit 1 according to the first embodiment except for a main routine described later. So, the different point will be mainly described hereinafter.

The electronic control unit 1 according to the third embodiment is designed to determine when the fail-safe process is required to be checked according to information indicative of date and time of starting of the vehicle, in other words, the electronic control unit.

The main routine to be executed by the CPU 181 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 7 as "SWITCHING OPERATION S".

When launching the main program Pr1, the CPU 181 reads a value of a prepared variable Dat and a criteria value D stored in the EEPROM 17 in step S610; this variable Dat represents the date and time of the previous starting of the vehicle, which will be referred to as the previous vehicle-start date and time Dat. Then, in step S610, the CPU 181 determines when the fail-safe process is required to be checked by determining whether the previous vehicle-start date and time Dat reaches the criteria value D. Note that, prior to shipping, the previous vehicle-start date and time Dat stored in the EEPROM 17 is set to a shipment inspection date and time D0, and the criteria value D is set to be greater than a value ΔD. That is, prior to shipping, the criteria value D is set to a value of "D0+ΔD". The previous vehicle-start date and time is an example of the parameter indicative of the amount of operation of the electronic control unit 1.

In this embodiment, the CPU 181 is programmed to determine that the fail-safe process is required to be checked every lapse of a preset period, and the value ΔD corresponds to the preset period. In accordance with the same inventive concept as that of the first embodiment, the value ΔD can be determined in the design stage of the electronic control device 1 according to the third embodiment such that the executing interval of the check of the fail-safe process does not exceed the half (T/2) of the average operating time T of the electronic control unit 1 until an abnormality, such as a random fault, occurs therein.

Upon determining that the previous vehicle-start date and time Dat does not reach the criteria value D, the CPU 181 determines that the fail-safe process is not required to be checked (NO in step S610), proceeding to step S630. Otherwise, upon determining that the previous vehicle-start date and time Dat reaches the criteria value D, the CPU 181 determines that the fail-safe process is required to be checked (YES in step S610).

Then, the CPU 181 updates the criteria value D to the sum of the criteria value D and the value ΔD, and resets the variable loop to zero, and updates each of the flag f and the flag res stored in the EEPROM 17 to ON in step S620, proceeding to step S630.

In step S630, the CPU 181 communicates with the meter ECU 5 via the CAN controller 189 and the transceiver/receiver 15 to thereby obtain, from the meter ECU 5, information indicative of the current date and time NT stored in the meter ECU 5, and updates a value of the previous vehicle-start date and time Dat to the obtained value NT from the meter ECU 5. Thereafter, the CPU 181 executes the operations in steps S640 to S670 identical to the operations in steps S240 to S270, respectively.

In the third embodiment, an instructing unit configured to instruct an executing unit to execute the specific process when an abnormality occurs in the target section can be implemented by, for example, the operation in step S650. A determining unit configured to determine when the specific process is required to be checked can be implemented by, for example, the operations in steps S610 and S660. A checking unit configured to instruct the executing unit to execute the specific process independently of whether an abnormality occurs in the target section each time it is determined that the specific process is required to be checked, thus checking whether an abnormality occurs in the specific process can be implemented by, for example, the operations in step S660 and steps S330 to S390. An obtaining unit configured to obtain information indicative of an amount of operation of the device can be implemented by, for example, the operation in step S630.

As described above, the electronic control unit 1 according to the third embodiment is configured to automatically carry out the check of the fail-safe process at a proper timing according to the elapsed period since the previous date and time of the starting of the vehicle. Thus, in addition to the technical effects achieved by the electronic control unit 1 according to the first embodiment, it is possible to more improve safety of each of vehicles in which the electronic control unit 1 according to the third embodiment is installed.

Fourth Embodiment

An electronic control unit 1 according to the fourth embodiment of the present invention will be described hereinafter with reference to FIG. 8.

The structure and/or functions of the electronic control unit 1 according to the fourth embodiment are substantially identical to those of the electronic control unit 1 according to the first embodiment except for a main routine described later. So, the different point will be mainly described hereinafter.

The main routine to be executed by the CPU 181 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 8 as "SWITCHING OPERATION S".

When launching the main program Pr1, the CPU 181 reads a value of a prepared variable Acc and a criteria value A stored in the EEPROM 17 in step S710; this variable Acc represents an accumulated operating time of the electronic control unit, which will be referred to as the accumulated operating time Acc. Then, in step S710, the CPU 181 determines when the fail-safe process is required to be checked by determining whether the accumulated operating time Acc reaches the criteria value A. The accumulated operating time is an example of the parameter indicative of the amount of operation of the electronic control unit 1.

Note that, prior to shipping, the previous accumulated operating time Acc stored in the EEPROM 17 is set to zero, and the criteria value A is set in accordance with the same inventive concept as that of the first embodiment. Specifically, the criteria value A can be determined in the design stage of the electronic control device 1 according to the fourth embodiment such that the executing interval of the check of the fail-safe process does not exceed the half (T/2) of the average operating time T of the electronic control unit 1 until an abnormality, such as a random fault, occurs therein.

Upon determining that the accumulated operating time Acc does not reach the criteria value A, the CPU 181 determines that the fail-safe process is not required to be checked (NO in step S710), proceeding to step S730. Otherwise, upon determining that the accumulated operating time Acc reaches the criteria value A, the CPU 181 determines that the fail-safe process is required to be checked (YES in step S710).

Then, the CPU 181 resets each of the accumulated operating time Acc and the variable loop to zero, and updates each of the flag f and the flag res stored in the EEPROM 17 to ON in step S720, proceeding to step S730.

In step S730, the CPU 181 determines whether a preset time AA has elapsed since the previous update point of time of the accumulated operating time Acc (see step S735 described later). Upon determining that the preset time ΔA has elapsed since the previous update point of time of the accumulated operating time Acc (YES in step S730), the CPU 181 proceeds to step S735. In step S735, the CPU 181 updates a value of the accumulated operating time Acc to the sum of the value of the accumulated operating time Acc and the preset time ΔA, proceeding to step S740.

Otherwise, upon determining that the preset time ΔA has not elapsed since the previous update point of time of the accumulated operating time Acc (NO in step S730), the CPU 181 proceeds to step S740 while skipping the operation in step S735. Thereafter, the CPU 181 executes the operations in steps S740 to S770 identical to the operations in steps S240 to S270, respectively.

In the fourth embodiment, an instructing unit configured to instruct an executing unit to execute the specific process when an abnormality occurs in the target section can be implemented by, for example, the operation in step S750. A determining unit configured to determine when the specific process is required to be checked can be implemented by, for example, the operations in steps S710 and S760. A checking unit configured to instruct the executing unit to execute the specific process independently of whether an abnormality occurs in the target section each time it is determined that the specific process is required to be checked, thus checking whether an abnormality occurs in the specific process can be implemented by, for example, the operations in step S760 and steps S330 to S390. An obtaining unit configured to obtain information indicative of an amount of operation of the device can be implemented by, for example, the operations in steps S730, S735, and S710.

As described above, the electronic control unit 1 according to the fourth embodiment is configured to determine when the fail-safe process is required to be checked according to the accumulated operating time thereof. Thus, in addition to the technical effects achieved by the electronic control unit 1 according to the first embodiment, it is possible to automatically carry out the check of the fail-safe process at intervals that are determined properly depending on variations of user's utility form of the vehicle.

Specifically, in the fourth embodiment, the check interval can be determined as the half (T/2) of the average operating time T of the electronic control unit 1 until an abnormality, such as a random fault, occurs therein.

Note that, in the fourth embodiment, if the CPU 181 updated the accumulated operating time of the electronic control unit 1 stored in the EEPROM 17 every short period of the preset time ΔA, this would reduce the lifetime of the EEPROM 17, resulting in reduction of the useful life of the electronic control unit 1. Thus, the electronic control unit 1 according to the fourth embodiment with a function of determining when the fail-safe process is required to be checked according to the accumulated operating time Acc can be preferably designed to continuously supply, from the power and monitor circuit 11, electric power to the microcomputer 18 after the ignition switch SW is turned off, and to update a value of the accumulated operating time Acc stored in the EEPROM 17 to the sum of the value of the accumulated operating time Acc and the preset time ΔA at the point of time when the ignition switch SW is turned off.

Fifth Embodiment

An electronic control unit 1A according to the fifth embodiment of the present invention will be described hereinafter with reference to FIGS. 9 and 10.

The structure and functions of the electronic control unit 1A according to the fifth embodiment are substantially identical to the electronic control unit 1 according to the fourth embodiment except that the electronic control unit 1A is equipped with a delay circuit 19 for continuously supplying electric power to the microcomputer 18, and a main routine is different from that according to the fourth embodiment. So, the different points will be mainly described hereinafter.

Referring to FIG. 9, the delay circuit 19 provided in the electronic control unit 1A includes an IG input circuit 191, a relay circuit 193, a RLY output circuit 195, and diodes 197 and 199.

The IG input circuit 191 aims to input, to the microcomputer 18, a status signal indicative of on/off of the ignition switch SW. Specifically, the IG input circuit 191 has an input terminal connected with the battery 3 via the ignition switch SW, and an output terminal connected with the microcomputer 18. The IG input circuit 191 is operative to, when the ignition switch SW is turned on, input, to the microcomputer 18, an on signal as the status signal; this on signal represents that the ignition switch SW is in on state. In addition, the IG input circuit 191 is operative to, when the ignition switch SW is turned off, input, to the microcomputer 18, an off signal as the status signal; this off signal represents that the ignition switch WS is in off state.

The relay circuit 193 is, for example, a normal relay circuit that closes an arbeit contact (a-contact) 193*a* using electromagnetic field generated by a coil 193*b*. One end of the coil 193*b* is connected via the diode 197 with a line (electrical wire) L1; this line L1 is connected between the ignition switch SW and the IG input circuit 191. The other end of the coil 193*b* is grounded. One end of the contact 193*a* is connected with the battery 3 via a line (electrical wire) L2, and the other end thereof is connected with the power and monitor circuit 11. The one end of the coil 193*b* is further connected with the RLY output circuit 195 via the diode 199.

Specifically, the relay circuit 193 is operative to close the contact 193*a* with the ignition switch SW being in on state or an on signal being inputted from the RLY circuit 195 thereto as a control signal to thereby supply electric power to the power and monitor circuit 11 from the battery 3. In addition, the relay circuit 193 is operative to open the contact 193*a* with the ignition switch SW being in off state and an off signal being inputted from the RLY circuit 195 thereto as the control signal to thereby interrupt the supply of electrical power from the battery 3 to the power and monitor circuit 11, and therefore to the microcomputer 18.

The RLY circuit 195 is operative to input, to the relay circuit 193, the on signal as the control signal for closing the contact 193*a* when its operating state is on state set by the microcomputer 18, and input, to the relay circuit 193, the off signal as the control signal for opening the contact 193*a* when its operating state is off state set by the microcomputer 18.

As described above, the relay circuit 19 is configured to control the supply of electric power to the power and monitor circuit 11 and, therefore, to the microcomputer 18 after the ignition switch SW is turned off.

The CPU 181 of the microcomputer 18 is configured to execute the main routine illustrated in FIG. 10 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 10 as "SWITCHING OPERATION S".

When launching the main program Pr1, the CPU 181 reads the accumulated operating time Acc and the criteria value A stored in the EEPROM 17 in step S710. Then, in step S710, the CPU 181 determines when the fail-safe process is required to be checked by determining whether the accumulated operating time Acc reaches the criteria value A.

Upon determining that the accumulated operating time Acc does not reach the criteria value A, the CPU 181 determines that the fail-safe process is not required to be checked (NO in step S710), proceeding to step S830. Otherwise, upon determining that the accumulated operating time Acc reaches the criteria value A, the CPU 181 determines that the fail-safe process is required to be checked (YES in step S710). Then, the CPU 181 proceeds to step S720. In step S720, the CPU 181 resets each of the accumulated operating time Acc and the variable loop to zero, and updates each of the flag f and the flag res stored in the EEPROM 17 to ON, proceeding to step S830.

In step S830, the CPU 181 sets the operating state of the RLY output circuit 195 to on state, and sets the accumulated operating time Acc stored in the EEPROM 17 to a variable t in step S831. The variable t is stored in the RAM 183 except for the EEPROM 17.

Following the operation in step S831, the CPU 181 proceeds to step S832, and determines whether the ignition switch SW is in off state in step S832. Upon determining that the ignition switch SW is in on state (NO in step S832), the CPU 181 determines whether a preset time ΔT has elapsed since the previous update point of time of the variable t (see step S834 described later). Upon determining that the preset time ΔT has elapsed since the previous update point of time of the variable t (YES in step S833), the CPU 181 updates a value of the variable t to the sum of the value of the variable t and the preset time ΔT in step S834, proceeding to step S840.

Otherwise, upon determining that the preset time ΔT has not elapsed since the previous update point of time of the variable t (NO in step S833), the CPU 181 proceeds to step S840 while skipping the operation in step S834.

In step S840, the CPU 181 executes the normal routine illustrated in FIG. 5 set forth above, and, after the completion of the normal routine, determines whether an abnormality occurs in the microcomputer 18 based on a result of the execution of the normal routine in step S850.

Upon determining that an abnormality occurs in the microcomputer 18 (YES in step S850), the CPU 181 jumps to the address in which the abnormal WD output program Pr2 is stored, exits the main routine, and executes the abnormal WD output routine in accordance with the abnormal WD output program Pr2 illustrated in FIG. 3.

Otherwise, upon determining that an abnormality does not occur in the microcomputer 18 (NO in step S850), the CPU 181 reads the flag f stored in the EEPROM 17, and determines whether the flag f is set to ON in step S860. Upon determining that the flag f is set to ON (YES in step S860), the CPU 181 proceeds to step S870, and jumps to the address in which the abnormal WD output program Pr2 is stored, exits the main routine, and executes the abnormal WD output routine in accordance with the abnormal WD output program Pr2 illustrated in FIG. 3.

On the other hand, upon determining that the flag f is set to OFF (NO in step S860), the CPU 181 proceeds to step S832, and repeatedly executes the operations in steps S832 to S860 until an abnormality occurs in the microcomputer 18 or the flag f is set to ON during the ignition switch SW being on state.

That is, during the ignition switch SW being on state, when the microcomputer 18 normally operates and the flag f is set to OFF, the variable t is repeatedly updated so that the accumulated operating time of the electronic control unit 1 up to now has been stored in the RAM 183. When the ignition switch SW is turned off, the CPU 181 carries out an affirmative determination in step S832, proceeding to step S880. In step S880, the CPU 181 updates the variable Acc stored in the EEPROM 17 to a value of the variable t, this value of the variable t represents the accumulated operating time of the electronic control unit 1 up to now. Thereafter, the CPU 181 sets the operating state of the RLY output circuit 195 to off state to thereby stop the supply of electric power from the power and monitor circuit 11 to each unit (section) of the electronic control unit 1A, existing the main routine in step S890.

As described above, the electronic control unit 1A according to the fifth embodiment is configured to limit the frequency of update of the accumulated operating time Acc stored in the EEPROM 17. This can restrict reduction in the lifetime of the EEPROM 17 to thereby restrict reduction in the useful life of the electronic control unit 1.

Sixth Embodiment

An electronic control unit 1A according to the sixth embodiment of the present invention will be described hereinafter with reference to FIG. 11.

The structure and functions of the electronic control unit 1A according to the sixth embodiment are substantially identical to the electronic control unit 1A according to the fifth embodiment except for a main routine different from that according to the fifth embodiment. So, the different points will be mainly described hereinafter.

The main routine to be executed by the CPU 181 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 11 as "SWITCHING OPERATION S".

When launching the main program Pr1, the CPU 181 sets the operating state of the RLY output circuit 195 to on state without executing the operations in steps S710 and S720, and sets the accumulated operating time Acc stored in the EEPROM 17 to the variable t in step S831.

Following the operation in step S831, the CPU 181 proceeds to step S832, and determines whether the ignition switch SW is in off state in step S832. Upon determining that the ignition switch SW is in on state (NO in step S832), the CPU 181 executes the operations in steps S833, S834, S840, S850, and S870 as well as the fifth embodiment except for the following point. Specifically, because the CPU 181 according to the sixth embodiment is programmed not to carry out the operation in step S860, when carrying out a negative determination in step S850, the CPU 181 proceeds to step S832.

Otherwise, upon determining that the ignition switch SW is in off state (YES in step S832), the CPU 181 proceeds to step S880. In step S880, the CPU 181 updates the variable Acc stored in the EEPROM 17 to a value of the variable t, this value of the variable t represents the accumulated operating time of the electronic control unit 1 up to now. Thereafter, the CPU 181 proceeds to step S881.

In step S881, the CPU 181 reads the accumulated operating time Acc stored in the EEPROM 17 and the criteria value A stored in the EEPROM 17, and determines whether the accumulated operating value Acc is equal to or greater than the criteria value A.

Upon determining that the accumulated operating value Acc is less than the criteria value A (NO in step S881), the CPU 181 determines that the fail-safe process is not required to be checked, proceeding to step S885. Otherwise, upon determining that the accumulated operating value Acc is equal to or greater than the criteria value A (YES in step S881), the CPU 181 determines that the fail-safe process is required to be checked, proceeding to step S883.

In step S883, the CPU 181 resets each of the accumulated operating time Acc and the variable loop to zero, and updates each of the flag f and the flag res stored in the EEPROM 17 to ON, proceeding to step S885.

In step S885, the CPU 181 reads the flag f stored in the EEPROM 17, and determines whether the flag f is set to ON. Upon determining that the flag f is set to ON (YES in step S885), the CPU 181 proceeds to step S870, and jumps to the address in which the abnormal WD output program Pr2 is stored, exits the main routine, and executes the abnormal WD output routine in accordance with the abnormal WD output program Pr2 illustrated in FIG. 3.

On the other hand, upon determining that the flag f is set to OFF (NO in step S885), the CPU 181 proceeds to step S890, and sets the operating state of the RLY output circuit 195 to off state to thereby stop the supply of electric power from the power and monitor circuit 11 to each unit (section) of the electronic control unit 1A, existing the main routine in step S890.

As described above, the electronic control unit 1A according to the sixth embodiment is configured to carry out the check of the fail-safe process during the vehicle being stopped (the ignition switch SW being in off state), thereby relieving concerns about execution of the affect of the fail-safe process checking task during the vehicle travelling.

Seventh Embodiment

An electronic control unit 1 according to the seventh embodiment of the present invention will be described hereinafter with reference to FIG. 12.

The structure and functions of the electronic control unit 1 according to the seventh embodiment are substantially identical to the electronic control unit 1 according to the first embodiment except that the electronic control unit 1 according to the seventh embodiment is configured to determine when the fail-safe process is required to be checked based on the number of Cnt of starts of the vehicle and the travelled distance Tri, and to learn and update the criteria value N and the value ΔK.

In other words, the electronic control unit 1 according to the seventh embodiment is configured to carry out a main routine, an abnormal WD output routine, and a normal routine, which are different from the respective main routine, abnormal WD output routine, and normal routine of the electronic control unit 1 according to the first embodiment.

Next, the main routine to be executed by the CPU 181 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 12 as "SWITCHING OPERATION S".

When launching the main program Pr1, the CPU 181 reads the number Cnt of starts of the vehicle, the criteria value N, and a flag f1 stored in the EEPROM 17 in step S911. Then, the CPU 181 determines whether the fail-safe process is required to be checked by determining whether the number Cnt of starts of the vehicle is equal to or higher than the criteria value N, and the flag f1 is set to OFF in step S911.

Upon determining that the number Cnt of starts of the vehicle is lower than the criteria value N or the flag f1 is set to ON (NO in step S911), the CPU 181 proceeds to step S915. Otherwise, upon determining that the number Cnt of starts of the vehicle is equal to or higher than the criteria value N and the flag f1 is set to OFF (YES in step S911), the CPU 181 proceeds to step S913. In step S913, the CPU 181 updates the flag f1 to ON, and updates a value of a prepared variable Min_C stored in the EEPROM 17 to the number Cnt of starts of the vehicle at this time, proceeding to step S915.

In step S915, the CPU 181 reads the travelled distance Tri, the criteria value K, and a flag f2 stored in the EEPROM 17, and determines whether the travelled distance Tri is equal to or higher than the criteria value K, and the flag f2 is set to OFF.

Upon determining that the travelled distance Tri is lower than the criteria value K or the flag f2 is set to ON (NO in step S915), the CPU 181 proceeds to step S921. Otherwise, upon determining that the travelled distance Tri is equal to or higher than the criteria value K and the flag f2 is set to OFF (YES in step S915), the CPU 181 proceeds to step S917. In step S917, the CPU 181 updates the flag f2 to ON, and updates a value of a prepared variable Min_T stored in the EEPROM 17 to the travelled distance Tri at this time, proceeding to step S921.

In step S921, the CPU 181 determines whether each of the flags f1 and f2 is set to ON, and upon determining that at least one of the flags f1 and f2 is set to OFF (NO in step S921), the CPU 181 updates the number Cnt of starts of the vehicle to the sum of the number Cnt of starts of the vehicle and 1, that is, increments the number Cnt of starts of the vehicle by 1 in step S923, proceeding to step S930.

Otherwise, upon determining that each of the flags f1 and f2 is set to ON (YES in step S921), the CPU 181 proceeds to step S925, and resets the variable loop stored in the EEPROM 17 to zero, and updates the flag res stored in the EEPROM 17 to ON. In step S925, the CPU 181 updates the criteria value N to a value that meets the following equation [1] using the number Cnt of starts of the vehicle and the variable Min_C stored in the EEPROM 17:

$$N \leftarrow \mathrm{MIN_C} + (Cnt - \mathrm{MIN_C}) \quad [1]$$

In other words, in step S925, the CPU 181 assigns the value defined by "MIN_C+(Cnt−MIN_C)" to the criteria value N.

Similarly, in step S925, the CPU 181 updates the value ΔK to a value that meets the following equation [2] using the travelled distance Tri, the variable Min_T, and the value ΔK stored in the EEPROM 17:

$$\Delta K \leftarrow \Delta K + (Tri - \mathrm{MIN_T})/2 \quad [2]$$

In step S925, the CPU 181 resets the number Cnt of starts of the vehicle to zero.

After the completion of the operation in step S925, the CPU 181 updates the criteria value K stored in the EEPROM 17 to the sum of the travelled distance Tri and the updated value ΔK in step S927, proceeding to step S930.

In step S930, the CPU 181 communicates with the meter ECU 5 via the CAN controller 189 and the transceiver/receiver 15 to thereby obtain, from the meter ECU 5, a current travelled distance (accumulated distance) M_Tri of the vehicle, and updates a value of the travelled distance Tri to the obtained value M_Tri from the EEPROM 17, proceeding to step S940.

In step S940, the CPU 181 executes the normal routine illustrated in FIG. 5. However, in the seventh embodiment, in step S330, the CPU 181 reads each of the flags f1, f2, and res from the EEPROM 17, and determines whether each of the flags f1 and f2 is set to OFF and the flag res is set to ON.

After the completion of the normal routine, the CPU 181 determines whether an abnormality occurs in the microcomputer 18 based on a result of the execution of the normal routine in step S950. Upon determining that an abnormality occurs in the microcomputer 18 (YES in step S950), the CPU 181 jumps to the address in which the abnormal WD output program Pr2 is stored, exits the main routine, and executes the abnormal WD output routine in accordance with the abnormal WD output program Pr2 illustrated in FIG. 3. Note that, in step S120 of the abnormal WD output routine, the CPU 181 according to the seventh embodiment updates each of the flags f1 and f2 stored in the EEPROM 17 to OFF.

Otherwise, upon determining that an abnormality does not occur in the microcomputer 18 (NO in step S950), the CPU 181 reads the flags f1 and f2 stored in the EEPROM 17, and determines whether each of the flags f1 and f2 is set to ON in step S960. Upon determining that each of the flags f1 and f2 is set to ON (YES in step S960), the CPU 181 proceeds to step S970, and jumps to the address in which the abnormal WD output program Pr2 is stored, exits the main routine, and executes the abnormal WD output routine in accordance with the abnormal WD output program Pr2 illustrated in FIG. 3.

On the other hand, upon determining that each of the flags f1 and f2 is set to OFF (NO in step S960), the CPU 181 proceeds to step S940, and repeatedly executes the normal routine illustrated in FIG. 5 until an abnormality occurs in the microcomputer 18 or each of the flags f1 and f2 is set to ON.

In the seventh embodiment, an instructing unit configured to instruct an executing unit to execute the specific process when an abnormality occurs in the target section can be implemented by, for example, the operation in step S950. A determining unit configured to determine when the specific process is required to be checked can be implemented by, for example, the operations in steps S911 to S921 and in step S960. A checking unit configured to instruct the executing unit to execute the specific process independently of whether an abnormality occurs in the target section each time it is determined that the specific process is required to be checked, thus checking whether an abnormality occurs in the specific process can be implemented by, for example, the operations in step S960 and steps S330 to S390. An obtaining unit configured to obtain information indicative of an amount of operation of the device can be implemented by, for example, the operations in step S923, S930, S911, and S915. A correcting unit can be implemented by, for example, the operations in steps S913, S917, and S925.

As described above, the electronic control unit 1 according to the seventh embodiment is configured to determine when the fail-safe process is required to be checked based on the number Cnt of starts of the vehicle and the travelled distance Tri. Thus, as compared with each of the electronic control units 1 according to the first and second embodiments, it is possible to automatically carry out the check of the fail-safe process at more proper intervals depending on variations of user's utility form of the vehicle.

For example, for users who frequently use vehicles for long-distance transport, the operating time per one vehicle start of the electronic control unit 1 according to the seventh embodiment, which is installed in each of such vehicles, is relatively longer than that of the electronic control unit 1 according to the seventh embodiment, which is installed in another vehicle. However, in view of increase in high-speed running, the operating time of the electronic control unit 1 relative to the travelled distance according to the seventh embodiment, which is installed in each of such vehicles, is relatively shorter than that of the electronic control unit 1 relative to the travelled distance according to the seventh embodiment, which is installed in another vehicle.

In contrast, for users who frequently use vehicles for short-distance transport, the operating time per one vehicle start of the electronic control unit 1 according to the seventh embodiment, which is installed in each of such vehicles, is relatively shorter than that of the electronic control unit 1 according to the seventh embodiment, which is installed in another vehicle. However, in view of increase in low-speed running, the operating time of the electronic control unit 1 relative to the travelled distance according to the seventh embodiment, which is installed in each of such vehicles, is relatively longer than that of the electronic control unit 1 relative to the travelled distance according to the seventh embodiment, which is installed in another vehicle.

As described above, the electronic control unit 1 according to the first embodiment determines when the fail-safe process is required to be checked based on the number Cnt of starts of the vehicle. For this reason, even for users who frequently use vehicles for long-distance transport, the criteria value N need to be strictly determined such that the check interval does not exceed the half (T/2) of the average operating time T of the electronic control unit 1 according to the first embodiment until an abnormality, such as a random fault, occurs therein.

On the other hand, the electronic control unit 1 according to the second embodiment determines when the fail-safe process is required to be checked based on the travelled distance Tri of the vehicle. For this reason, even for users who frequently use vehicles for short-distance transport, the value ΔK need to be strictly determined such that the check interval does not exceed the half (T/2) of the average operating time T of the electronic control unit 1 according to the first embodiment until an abnormality, such as a random fault, occurs therein.

In contrast, the electronic control unit 1 according to the seventh embodiment is configured to, even if each of the criteria value N and the value ΔK is strictly determined depending on variations of user's utility form of the vehicle, carry out the check of the fail-safe process only when the first condition of "Cnt≥N" and the second condition of "Tri≥K" are met. Specifically, the electronic control unit 1 according to the seventh embodiment can carry out the check of the fail-safe process at proper intervals in accordance with a properly set value of the first condition and a properly set value of the second condition so as to meet variations of user's utility form of the vehicle.

In addition, the electronic control unit according to the seventh embodiment is configured to:

update, based on the number Min_C of starts of the vehicle when the first condition of "Cnt≥N" is met and the number Cnt of starts of the vehicle when both of the first and second conditions are met, the criteria value N such that the difference "Cnt−Min_C" is reduced; and update, based on the travelled distance Min_T when the second condition of "Tri≥K" is met and the travelled distance Tri when both of the first and second conditions are met, the value ΔK such that the difference "Tri−Min_T" is reduced.

Thus, the electronic control unit according to the seventh embodiment can correct each of the criteria value N and the value ΔK according to a user's utility form of the vehicle such that:

the check interval does not exceed the half (T/2) of the average operating time T of the electronic control unit 1 until an abnormality, such as a random fault, occurs therein, and approaches the half (T/2) of the average operating time T of the electronic control unit 1.

Accordingly, the electronic control unit according to the seventh embodiment can carry out the check of the fail-safe process at further proper timings.

Eighth Embodiment

An electronic control unit 1 according to the eighth embodiment of the present invention will be described hereinafter with reference to FIG. 13.

The structure and functions of the electronic control unit 1 according to the eighth embodiment are substantially identical to the electronic control unit 1 according to the seventh embodiment except that the electronic control unit 1 according to the eighth embodiment is configured to determine when the fail-safe process is required to be checked based on the number of Cnt of starts of the vehicle and the previous vehicle-start date and time Dat, and to learn and update the criteria value N and the value ΔD.

In other words, the electronic control unit 1 according to the eighth embodiment is configured to carry out a main routine, which is different from the main routine of the electronic control unit 1 according to the seventh embodiment.

Next, the main routine to be executed by the CPU 181 in accordance with the main program Pr1 each time the CPU 181 is booted up will be fully described hereinafter. As described above, the procedure to alternately switch between the high signal and the low signal as the watch-dog signal within the constant time T0 is incorporated beforehand in the main routine. The operation of the CPU 181 using the procedure is schematically illustrated in FIG. 13 as "SWITCHING OPERATION S".

When launching the main program Pr1, the CPU 181 executes the operation in step S1011, which is identical to the operation in step S911. Upon determining that the number Cnt of starts of the vehicle is lower than the criteria value N or the flag f1 is set to ON (NO in step S1011), the CPU 181 proceeds to step S1015. Otherwise, upon determining that the number Cnt of starts of the vehicle is equal to or higher than the criteria value N and the flag f1 is set to OFF (YES in step S1011), the CPU 181 proceeds to step S1013.

In step S1013, the CPU 181 updates the flag f1 to ON, and updates a value of the variable Min_C stored in the EEPROM 17 to the number Cnt of starts of the vehicle at this time, proceeding to step S1015.

In step S1015, the CPU 181 reads the previous vehicle-start date and time Dat, the criteria value D, and the flag f2 stored in the EEPROM 17, and determines whether the previous vehicle-start date and time Dat reaches the criteria value D, and the flag f2 is set to OFF.

Upon determining that the previous vehicle-start date and time Dat does not reach the criteria value D or the flag f2 is set to ON (NO in step S1015), the CPU 181 proceeds to step S1021. Otherwise, upon determining that the previous vehicle-start date and time Dat reaches the criteria value K and the flag f2 is set to OFF (YES in step S1015), the CPU 181 proceeds to step S1017. In step S1017, the CPU 181 updates the flag f2 to ON, and updates a value of a prepared variable Min_D stored in the EEPROM 17 to the previous vehicle-start date and time Dat at this time, proceeding to step S1021.

In step S1021, the CPU 181 determines whether each of the flags f1 and f2 is set to ON, and upon determining that at least one of the flags f1 and f2 is set to OFF (NO in step S1021), the CPU 181 updates the number Cnt of starts of the vehicle to the sum of the number Cnt of starts of the vehicle and 1, that is, increments the number Cnt of starts of the vehicle by 1 in step S1023, proceeding to step S1030.

Otherwise, upon determining that each of the flags f1 and f2 is set to ON (YES in step S1021), the CPU 181 proceeds to step S1025, and resets the variable loop stored in the EEPROM 17 to zero, and updates the flag res stored in the EEPROM 17 to ON. In step S1025, the CPU 181 updates the criteria value N to a value that meets the following equation [1] using the number Cnt of starts of the vehicle and the variable Min_C ΔK stored in the EEPROM 17:

$$N \leftarrow \mathrm{MIN_}C + (Cnt - \mathrm{MIN_}C) \quad [1]$$

Similarly, in step S1025, the CPU 181 updates the value ΔD to a value that meets the following equation [3] using the previous vehicle-start date and time Dat, the variable Min_D, and the value ΔD stored in the EEPROM 17:

$$\Delta D \leftarrow \Delta D + (Dat - \mathrm{MIN_}D)/2 \quad [3]$$

In step S1025, the CPU 181 resets the number Cnt of starts of the vehicle to zero.

After the completion of the operation in step S1025, the CPU 181 updates the criteria value D stored in the EEPROM 17 to the sum of the previous vehicle-start date and time Dat and the updated value ΔD in step S1027, proceeding to step S1030.

In step S1030, the CPU 181 communicates with the meter ECU 5 via the CAN controller 189 and the transceiver/receiver 15 to thereby obtain, from the meter ECU 5, information indicative of the current date and time NT stored in the meter ECU 5, and updates a value of the previous vehicle-start date and time Dat to the obtained value NT from the EEPROM 17, proceeding to step S1040.

Thereafter, the CPU 181 executes the operations in steps S1040 to S1070 identical to the operations in steps S940 to S970, respectively.

In the eighth embodiment, an instructing unit configured to instruct an executing unit to execute the specific process when an abnormality occurs in the target section can be implemented by, for example, the operation in step S1050. A determining unit configured to determine when the specific process is required to be checked can be implemented by, for example, the operations in steps S1011 to S1021 and in step S1060. A checking unit configured to instruct the executing unit to execute the specific process independently of whether an abnormality occurs in the target section each time it is determined that the specific process is required to be checked, thus checking whether an abnormality occurs in the specific process can be implemented by, for example, the operations in step S1060 and steps S330 to S390. An obtaining unit configured to obtain information indicative of an amount of operation of the device can be implemented by, for example, the operations in step S1023 and S1021. A date and time obtaining unit configured to obtain information indicative of a current date and time can be implemented by, for example, the operations in steps S1030 and S1015. A correcting unit can be implemented by, for example, the operations in steps S1013, S1017, and S1025.

As described above, the electronic control unit 1 according to the eighth embodiment is configured to determine when the fail-safe process is required to be checked based on the number Cnt of starts of the vehicle and the previous vehicle-start date and time Dat. Thus, as compared with each of the electronic control units 1 according to the first and third embodiments, it is possible to automatically carry out the check of the fail-safe process at more proper intervals depending on variations of user's utility form of the vehicle.

In addition, the electronic control unit according to the eighth embodiment is configured to:

update, based on the number Min_C of starts of the vehicle when the first condition of "Cnt≥N" is met and the number Cnt of starts of the vehicle when both of the first and second conditions are met, the criteria value N such that the difference "Cnt−Min_C" is reduced; and update, based on the previous vehicle-start date and time Dat when a third condition of "Dat≥D" is met and the previous vehicle-start date and time Dat when both of the first and third conditions are met, the value ΔD such that the difference "Dat−Min_D" is reduced.

Thus, the electronic control unit according to the eighth embodiment can correct each of the criteria value N and the value ΔD according to a user's utility form of the vehicle such that:

the check interval does not exceed the half (T/2) of the average operating time T of the electronic control unit 1 until an abnormality, such as a random fault, occurs therein, and approaches the half (T/2) of the average operating time T of the electronic control unit 1.

Accordingly, the electronic control unit according to the eighth embodiment can carry out the check of the fail-safe process at further properly timings.

The electronic control unit 1 according to the first embodiment has the lowest operation complexity in all of the electronic control units according to the first to eighth embodiments because the electronic control unit 1 according to the first embodiment need not to access the meter ECU 5 and has a low access frequency to the EEPROM 17.

The electronic control unit 1 according to the fourth embodiment can carry out the check of the fail-safe task in most properly timings as compared with the electronic control unit of another embodiment.

The aspects of the present invention are not limited to the first to eighth embodiments.

Specifically, in each of the first to eighth embodiments, as illustrated in FIG. 14, a non-operation code NOP can be inserted in the head of the abnormal WD output program Pr2 so that the free space of the program area of the microcomputer 18, that is, the ROM 182 can be full of the non-operation code. Using all available space of the program area of the microcomputer 18 allows checking whether a hardware abnormality occurs in all program area of the microcomputer 18.

The electronic control unit according to each of the first to eighth embodiments can be configured to start the abnormal WD output routine each time of connection of the battery 3 with the ignition switch SW and the electronic control unit. Specifically, in step S210 (see FIG. 4), the CPU 181 determines whether the battery 3 was removed and another battery 3 is connected with the ignition switch SW and the electronic control unit.

In this modification, the main routine can be changed such that, upon determining that the battery 3 was removed and another battery 3 is connected with the ignition switch SW and the electronic control unit (YES in step S210), the CPU 181 proceeds to step S230, and, otherwise, upon determining that the battery 3 is continuously connected with the ignition switch SW and the electronic control unit without being removed therefrom (NO in step S210), the CPU 181 proceeds to step S240. This modification allows the electronic control unit to automatically carry out the check of the fail-safe process at vehicle-safety inspection.

In each of the first to eighth embodiments, the main routine including a process to determine when the fail-safe process is required to be checked is carried out each time the microcomputer 18 is reset, but the process to determine when the fail-safe process is required to be checked can be carried out without the vehicle travelling. For example, the process to determine when the fail-safe process is required to be checked can be carried out after a drive of the vehicle is terminated.

In the first to eighth embodiments, parameters (information) indicative of the amount of operation of the electronic control unit can include parameters (information) that directly or indirectly represent the amount of operation of the electronic control unit.

While illustrative embodiments of the invention have been described herein, the present invention is not limited to the various embodiments described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be constructed as non-exclusive.

What is claimed is:

1. A device installed in a vehicle for monitoring a target section in the vehicle, the device comprising:

an executing unit configured to execute a fail-safe process for addressing an abnormality in the target section;

an instructing unit configured to instruct the executing unit to execute the fail-safe process when an abnormality occurs in the target section;

a determining unit configured to determine when the fail-safe process is required to be checked;

a checking unit configured to instruct the executing unit to execute the fail-safe process independently of whether an abnormality occurs in the target section each time it is determined that the fail-safe process is required to be checked, thus checking whether an abnormality occurs in the fail-safe process;

an obtaining unit configured to obtain, as information indicative of an amount of operation of the device, information indicative of a plurality of types of parameters indicative of the amount of operation of the device, the determining unit being configured to determine that the fail-safe process is required to be checked each time all of the plurality of types of parameters indicative of the amount of operation of the device respectively meet a plurality of preset conditions, the plurality of preset conditions being previously set respectively for the plurality of types of parameters indicative of the amount of operation of the device; and a correcting unit configured to correct each of the plurality of preset conditions based on a difference between a first timing at which the fail-safe process is required to be checked upon all of the plurality of types of parameters respectively meeting the plurality of preset conditions and a second timing at which each of the plurality of types of parameters indicative of the amount of operation of the device meets a corresponding one of the plurality of preset conditions.

2. The device according to claim 1, further comprising:

a date and time obtaining unit configured to obtain information indicative of a current date and time, wherein the determining unit is configured to determine that the fail-safe process is required to be checked each time the current date and time obtained by the date and time obtaining unit meets a preset second condition.

3. The device according to claim 1, wherein the correcting unit is configured to correct each of the plurality of preset conditions so that a time required for each of the plurality of preset conditions to be met approaches a time required for all of the plurality of preset conditions to be met.

4. The device according to claim 1, wherein the determining unit is configured to determine when the fail-safe process is required to be checked for each of the plurality of types of parameters indicative of the amount of operation of the device by determining whether each of the plurality of types of parameters indicative of the amount of operation of the device increases by a corresponding preset amount, the preset amount being preset for each of the plurality of types of parameters indicative of the amount of operation of the device, the device further comprising:

a correcting unit configured to:

obtain an increase in each of the plurality of types of parameters indicative of the amount of operation of the device over a period from a timing when a corresponding one of the plurality of types of parameters of the information meets a corresponding one of the plurality of preset conditions to a timing when all of the plurality of types of parameters indicative of the amount of operation of the device respectively meets the plurality of preset conditions, and add a preset percentage of the increase in each of the plurality of types of parameters indicative of the amount of operation of the device to the preset amount for a corresponding one of the plurality of types of parameters indicative of the amount of operation of the device to thereby correct the preset amount therefor.

5. The device according to claim 2, wherein the determining unit is configured to determine the first preset condition is met when the amount of operation of the device obtained by the obtaining unit increases by a first preset amount, and determine the second preset condition is met when the current date and time obtained by the date and time obtaining unit increases by a second preset amount, further comprising:

a correcting unit configured to:

obtain, when the second preset condition is met after the first preset condition is met, a first increase in the amount of operation of the device over a period from a timing when the amount of operation of the device meets the first preset condition to a timing when the first and second preset conditions are met;

add a preset percentage of the first increase to the first preset amount to thereby correct the first preset amount;

obtain, when the first preset condition is met after the second preset condition is met, a second increase in an elapsed time from a timing when the second preset condition is met to a timing when the first and second preset conditions are met; and add a preset percentage of the second increase to the second preset amount to thereby correct the second preset amount.

6. The device according to claim 1, wherein the obtaining unit is configured to obtain, as the information indicative of the amount of operation of the device, a number of starts of the vehicle.

7. The device according to claim 1, wherein the obtaining unit is configured to obtain, as the information indicative of the amount of operation of the device, a travelled distance of the vehicle.

8. The device according to claim 1, wherein the obtaining unit is configured to obtain, as the information indicative of the amount of operation of the device, an accumulated operating time of the vehicle.

9. The device according to claim 1, further comprising:

a date and time obtaining unit configured to obtain information indicative of a current date and time, wherein the determining unit is configured to determine that the fail-safe process is required to be checked each time the current date and time obtained by the obtaining unit meets a preset condition.

10. The device according to claim 1, further comprising:

an external output unit configured to output information indicative of a result of the check of the fail-safe process externally of the vehicle.

11. The device according to claim 1, wherein the determining unit is configured to determine when the fail-safe process is required to be checked as long as any one of the vehicle is booted up and a drive of the vehicle is terminated.

12. The device according to claim 1, wherein the device comprises a microcomputer incorporating a program area in which a first program for predetermined control of the vehicle is stored, the microcomputer being designed to execute the first program to thereby implement the predetermined control of the vehicle, the program area storing therein a second program that causes the microcomputer to function as each of the executing unit, the instructing unit, the determining unit, and the checking unit, the fail-safe process to reset the microcomputer as the target section.

13. The device according to claim 12, wherein the program area stores therein a third program that causes the microcomputer to execute the fail-safe process, the third program including at a head thereof a non-operation code, the program area having a free space area in which the non-operation code being full of the non-operation code.

14. A device installed in a vehicle for monitoring a target section in the vehicle, the device comprising:

an executing unit configured to execute a fail-safe process for addressing an abnormality in the target section;

an instructing unit configured to instruct the executing unit to execute the fail-safe process when an abnormality occurs in the target section;

a trigger timing generating unit configured to automatically generate a trigger timing for checking whether an abnormality occurs in the fail-safe process;

a checking unit configured to instruct the executing unit to execute the fail-safe process in response to the trigger timing generated by the trigger timing generating unit;

an obtaining unit configured to obtain, as information indicative of an amount of operation of the device, information indicative of a plurality of types of parameters indicative of the amount of operation of the device, the trigger timing generating unit being configured to automatically generate the trigger timing for checking whether an abnormality occurs in the fail-safe process each time all of the plurality of types of parameters indicative of the amount of operation of the device respectively meet a plurality of preset conditions, the plurality of preset conditions being previously set respectively for the plurality of types of parameters indicative of the amount of operation of the device; and a correcting unit configured to correct each of the plurality of preset conditions based on a difference between a first timing at which the fail-safe process is required to be checked upon all of the plurality of types of parameters respectively meeting the plurality of preset conditions and a second timing at which each of the plurality of types of parameters indicative of the amount of operation of the device meets a corresponding one of the plurality of preset conditions.

15. The device according to claim 14, wherein the trigger timing generating unit is configured to automatically generate the trigger timing for checking whether an abnormality occurs in the fail-safe process independently of whether an abnormality occurs in the target section.

16. The device according to claim 14, wherein the trigger timing generating unit is configured to automatically generate the trigger timing for checking whether an abnormality occurs in the fail-safe process without the vehicle travelling.

* * * * *